US010249251B2

(12) United States Patent
Yata et al.

(10) Patent No.: US 10,249,251 B2
(45) **Date of Patent: *Apr. 2, 2019**

(54) DISPLAY DEVICE

(71) Applicant: Japan Display Inc., Tokyo (JP)

(72) Inventors: Tatsuya Yata, Tokyo (JP); Takayuki Nakanishi, Tokyo (JP); Masaya Tamaki, Tokyo (JP)

(73) Assignee: Japan Display Inc., Tokyo (JP)

( * ) Notice: Subject to any disclaimer, the term of this patent is extended or adjusted under 35 U.S.C. 154(b) by 322 days.

This patent is subject to a terminal disclaimer.

(21) Appl. No.: 15/215,840

(22) Filed: Jul. 21, 2016

(65) Prior Publication Data

US 2017/0047020 A1 Feb. 16, 2017

(30) Foreign Application Priority Data

Aug. 10, 2015 (JP) ..... 2015-158563

(51) Int. Cl.

| | |
|---|---|
| ***G09G 5/00*** | (2006.01) |
| ***G09G 3/34*** | (2006.01) |
| ***G09G 3/36*** | (2006.01) |
| ***G09G 5/10*** | (2006.01) |

(52) U.S. Cl.

CPC ..... *G09G 3/3413* (2013.01); *G09G 3/3607* (2013.01); *G09G 5/10* (2013.01); *G09G 2300/0452* (2013.01); *G09G 2320/0271* (2013.01); *G09G 2320/0626* (2013.01); *G09G 2320/0646* (2013.01); *G09G 2360/144* (2013.01)

(58) Field of Classification Search

CPC ..... G09G 3/3413; G09G 3/3607; G09G 5/10; G09G 2320/0626; G09G 2320/0646; G09G 2320/0271; G09G 2300/0452; G09G 2360/144

See application file for complete search history.

(56) References Cited

U.S. PATENT DOCUMENTS

2011/0096084 A1* 4/2011 Hu ..... G09G 3/3413 345/589
2014/0292632 A1* 10/2014 Chen ..... G09G 3/3406 345/102
2015/0213781 A1* 7/2015 Huang ..... G09G 5/10 345/207

FOREIGN PATENT DOCUMENTS

JP 2013-218057 A 10/2013

* cited by examiner

*Primary Examiner* — Nelson M Rosario
*Assistant Examiner* — Andrew Lee
(74) *Attorney, Agent, or Firm* — K&L Gates

(57) ABSTRACT

According to an aspect, a display device includes: a display unit a plurality of pixels performing that perform color reproduction by combining outputs of sub-pixels; an illumination unit including a first light source, a second light source, and a third light source; a measuring unit that measures intensity of light included in external light other than the light from the illumination unit; and a control unit that controls the intensity of the light to be emitted from each of the first light source, the second light source, and the third light source and controls gradation values of the respective sub-pixels based on the intensity of the external light measured by the measuring unit.

8 Claims, 19 Drawing Sheets

FIG.16

| | DEFINITION OF WHITE OF INPUT SIGNAL | WHITE POINT | CORRECTED GRADATION VALUES OF WHITE |
|---|---|---|---|
| (STRONG) COLOR COMPO-NENT (WEAK) | R G B | R G B | R G B |
| RGB GRADATION VALUE | 255, 255, 255 | 255, 204, 204 | 255, 204, 204 |
| R:G:B RATIO | 1:1:1 | 1:0.8:0.8 | 1:0.8:0.8 |

FIG.17

| | INPUT SIGNAL | WHITE POINT | MAGNIFICATION OF LUMINANCE (N) | NECESSARY LUMINANCE VALUE |
|---|---|---|---|---|
| (STRONG) COLOR COMPONENT (WEAK) | R G B | R G B (1:0.8:0.8) | × 2 | R G B |
| EX-PRESSION | | | | |
| R | 180 | × 1 | × 2 | = 360 |
| G | 225 | × 0.8 | × 2 | = 360 |
| B | 80 | × 0.8 | × 2 | = 128 |

FIG. 18
| | NECESSARY LUMINANCE VALUE (Rt, Gt, Bt) | MAXIMUM VALUE OF REFLECTION LUMINANCE OF EXTERNAL LIGHT | LUMINANCE REQUIRED TO BE SUPPLEMENTED (Rt, Gt, Bt) |
|---|---|---|---|
| (STRONG) COLOR COMPONENT (WEAK) | 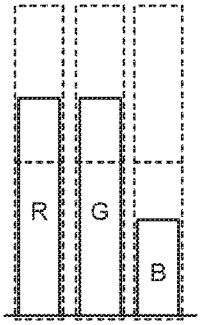 | 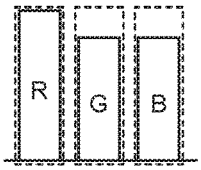 | 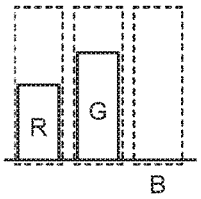 |
| EXPRESSION | | | |
| R | 360 | -255 | =105(Rf) |
| G | 360 | -204 | =156(Gf) |
| B | 128 | -204 | =0(Bf) |
FIG. 19
| UNIT OF PROCESSING | NECESSARY LUMINANCE VALUE OF UNIT PIXEL | | | LUMINANCE REQUIRED TO BE SUPPLEMENTED | | | INTENSITY OF INTERNAL LIGHT | | |
|---|---|---|---|---|---|---|---|---|---|
| | Rt | Gt | Bt | Rf | Gf | Bf | $IL_1$ | $IL_2$ | $IL_3$ |
| $U_1$ | 360 | 360 | 128 | 105 | 156 | 0 | 0.41 | 0.61 | 0 |
| | 300 | 300 | 100 | | | | | | |
| | 200 | 200 | 50 | | | | | | |
| | 100 | 100 | 25 | | | | | | |
| | 50 | 50 | 0 | | | | | | |
| | | | | | | | | | |
| $U_2$ | 360 | 250 | 100 | 105 | | | 0.41 | 0.61 | 0 |
| | 300 | 360 | 100 | | 156 | | | | |
| | 100 | 100 | 128 | | | 0 | | | |
| | 100 | 100 | 25 | | | | | | |
| | 50 | 50 | 0 | | | | | | |
| | | | | | | | | | |

FIG.20
| | NECESSARY LUMINANCE VALUE (Rt, Gt, Bt) | INTERNAL LIGHT + EXTERNAL LIGHT | OUTPUT SIGNAL |
|---|---|---|---|
| (STRONG) COLOR COMPONENT (WEAK) | 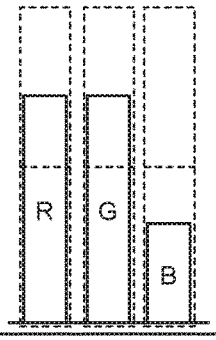  | 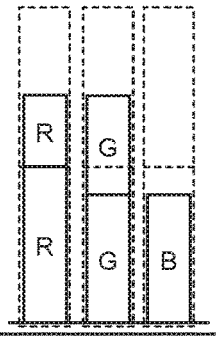  | 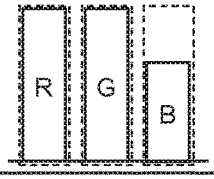  |
| EXPRESSION | | | |
| R | 360 | /{(255+105)/255} | =255 |
| G | 360 | /{(204+156)/255} | =255 |
| B | 128 | /{(204+0)/255} | =160 |
FIG.21
| UNIT OF PROCESSING | MAXIMUM NECESSARY LUMINANCE VALUE OF EACH COLOR | | | INTENSITY OF INTERNAL LIGHT | | |
|---|---|---|---|---|---|---|
| | Rt | Gt | Bt | $IL_1$ | $IL_2$ | $IL_3$ |
| U1 | 360 | 360 | 128 | 0.41 | 0.61 | 0 |
| U2 | 360 | 360 | 128 | 0.41 | 0.61 | 0 |
| U3 | 360 | 128 | 128 | 0.41 | 0 | 0 |
| U4 | 200 | 200 | 128 | 0 | 0 | 0 |
| | | | | | | |

| UNIT OF PRO-CESSING | NECESSARY LUMINANCE VALUE OF UNIT PIXEL | | | INTENSITY OF INTERNAL LIGHT | | | OUTPUT SIGNAL | | |
|---|---|---|---|---|---|---|---|---|---|
| | Rt | Gt | Bt | $IL_1$ | $IL_2$ | $IL_3$ | $O_1$ | $O_2$ | $O_3$ |
| $U_1$ | 360 | 360 | 128 | 0.41 | 0.61 | 0 | 255 | 255 | 160 |
| | 300 | 300 | 100 | | | | 213 | 213 | 120 |
| | 200 | 200 | 50 | | | | 142 | 142 | 60 |
| | 100 | 100 | 25 | | | | 71 | 71 | 30 |
| | 50 | 50 | 0 | | | | 35 | 35 | 0 |
| | | | | | | | | | |

FIG.24

| | NECESSARY LUMINANCE VALUE (RGB) | RATIO OF WHITE POINT | WHITE COMPONENT THAT CAN BE EXTRACTED | NECESSARY LUMINANCE VALUE (RGBW) | MAXIMUM VALUE OF REFLECTION LUMINANCE OF EXTERNAL LIGHT | LUMINANCE REQUIRED TO BE SUPPLEMENTED (Rf, Gf, Bf) |
|---|---|---|---|---|---|---|
| (STRONG) COLOR COMPONENT (WEAK) | R G B | R G B | R G B | R G B W | R G B | R G B |
| GRADATION VALUE | 360, 360, 128 | (1:0.8:0.8) | 160, 128, 128 | 200, 232, 0, 160 | 255, 208, 208 | 0, 28, 0 |

FIG.26

| | | NECESSARY LUMINANCE VALUE (RGB) | AFTER GAIN IS APPLIED TO DATA (RGB) | OUTPUT GRADATION VALUE (RGBW) |
|---|---|---|---|---|
| FIRST | (STRONG) COLOR COMPONENT (WEAK) | R B G | R B G | R B G W |
| | GRADATION VALUE | 510, 0, 255 | 255, 0, 255 | 255, 0, 255, 0 |
| SECOND | (STRONG) COLOR COMPONENT (WEAK) | R G B | R G B | G W R B |
| | GRADATION VALUE | 128, 510, 128 | 64, 340, 128 | 0, 276, 0, 64 |

FIG.27

| | NECESSARY LUMINANCE VALUE (RGB) | | | NECESSARY LUMINANCE VALUE (RGBW) | | | | PIXEL REFLECTION AMOUNT (RGB) | | | EXTERNAL LIGHT INTENSITY (RGB) | | | FRONT LIGHT INTENSITY (RGB) | | |
|---|---|---|---|---|---|---|---|---|---|---|---|---|---|---|---|---|
| | R | G | B | R | G | B | W | R | G | B | R | G | B | R | G | B |
| FIRST | 510 | 0 | 255 | 510 | 0 | 255 | 0 | 510 | 0 | 255 | 1 | 1 | 1 | 1 | 0 | 0 |
| SECOND | 128 | 510 | 128 | 0 | 383 | 0 | 128 | 128 | 383 | 128 | | | | 0 | 0.5 | 0 |

FIG.28

| | NECESSARY LUMINANCE VALUE (RGB) | | | AFTER GAIN IS APPLIED TO DATA (RGB) | | | OUTPUT GRADATION VALUE (RGBW) | | | |
|---|---|---|---|---|---|---|---|---|---|---|
| | R | G | B | R | G | B | R | G | B | W |
| FIRST | 510 | 0 | 255 | 255 | 0 | 255 | 255 | 0 | 255 | 0 |
| SECOND | 128 | 510 | 128 | 64 | 340 | 128 | 0 | 276 | 64 | 64 |

FIG.29

| | NECESSARY LUMINANCE VALUE (RGB) | | | FRONT LIGHT INTENSITY (RGB) | | | OUTPUT GRADATION VALUE (RGBW) | | | |
|---|---|---|---|---|---|---|---|---|---|---|
| | R | G | B | R | G | B | R | G | B | W |
| FIRST | 510 | 0 | 255 | 1 | 0.667 | 0.333 | 255 | 0 | 191 | 0 |
| SECOND | 128 | 510 | 128 | | | | 0 | 242 | 32 | 85 |

| | NECESSARY LUMINANCE VALUE (RGB) | | | FRONT LIGHT INTENSITY (RGB) | | | OUTPUT GRADATION VALUE (RGBW) | | | |
|---|---|---|---|---|---|---|---|---|---|---|
| | R | G | B | R | G | B | R | G | B | W |
| FIRST | 510 | 0 | 255 | 1 | 0.6 | 0 | 255 | 0 | 255 | 0 |
| SECOND | 128 | 510 | 128 | | | | 0 | 255 | 64 | 85 |

DISPLAY DEVICE

CROSS-REFERENCE TO RELATED APPLICATIONS

This application claims priority to Japanese Application No. 2015-158563, filed on Aug. 10, 2015, the contents of which are incorporated by reference herein in its entirety.

BACKGROUND

1. Technical Field

The present invention relates to a display device.

2. Description of the Related Art

In the related art, display devices have been developed that include a lighting apparatus (front light) for emitting light from a dedicated light source to a display panel in which a reflective display element is arranged.

A reflective display device reflects light other than the light from the dedicated light source such as light around the display device. That is, in the reflective display device, light other than the light from the dedicated light source affects brightness of a display output. Reflective display devices in the related art use light from the dedicated light source for display when the intensity of light (for example, external light) other than the light from the dedicated light source is low, or when a user determines that the light from the dedicated light source is necessary. However, the display output may be extremely bright depending on the intensity of the light other than the light from the dedicated light source. An output of the light from the dedicated light source is kept constant to be used in accordance with the intensity of the external light, so that electric power depends on the external light intensity.

For the foregoing reasons, there is a need for a display device that can perform display output with brightness according to the intensity of light (for example, external light) other than the light from the dedicated light source, and can reduce a light source output with image data even when the dedicated light source is required.

SUMMARY

According to an aspect, a display device that is a reflective display device includes: a display unit including a plurality of pixels performing color reproduction by combining outputs of sub-pixels of three or more colors including at least a first color, a second color, and a third color; an illumination unit including a first light source that emits light in the first color to the display unit, a second light source that emits light in the second color to the display unit, and a third light source that emits light in the third color to the display unit; a measuring unit that measures intensity of light in each color of the first color, the second color, and the third color included in external light that is light other than the light from the illumination unit out of the light emitted to the display unit; and a control unit that controls the intensity of the light to be emitted from each of the first light source, the second light source, and the third light source and controls gradation values of the respective sub-pixels based on the intensity of the external light measured by the measuring unit. The control unit individually performs, on the sub-pixel of the first color, the sub-pixel of the second color, and the sub-pixel of the third color, processing of calculating a necessary luminance value for obtaining luminance that is N times a luminance value indicated by an input signal in a sub-pixel that performs output with a highest gradation value among the sub-pixels included in a predetermined image display region in the display unit, N being larger than 0, The control unit determines the intensity of the light to be emitted from each of the first light source, the second light source, and the third light source based on a comparison result between the necessary luminance value and the intensity of the light in each of the first color, the second color, and the third color included in the external light. The control unit calculates an output gradation value of each of the sub-pixel of the first color, the sub-pixel of the second color, and the sub-pixel of the third color based on the following expressions (1), (2), and (3):

$$O_1=I_1\times N/(OL_1+IL_1) \quad (1),$$

$$O_2=I_2\times N/(OL_2+IL_2) \quad (2), \text{ and}$$

$$O_3=I_3\times N/(OL_3+IL_3) \quad (3),$$

where $OL_1$ is the intensity of the light in the first color included in the external light, $OL_2$ is the intensity of the light in the second color included in the external light, $OL_3$ is the intensity of the light in the third color included in the external light, $IL_1$ is the intensity of the light to be emitted from the first light source, $IL_2$ is the intensity of the light to be emitted from the second light source, $IL_3$ is the intensity of the light to be emitted from the third light source, $I_1$ is the gradation value of the first color indicated by the input signal, $I_2$ is the gradation value of the second color indicated by the input signal, $I_3$ is the gradation value of the third color indicated by the input signal, $O_1$ is the output gradation value for the sub-pixel of the first color, $O_2$ is the output gradation value for the sub-pixel of the second color, and $O_3$ is the output gradation value for the sub-pixel of the third color.

BRIEF DESCRIPTION OF THE DRAWINGS

FIG. 16 is a schematic diagram illustrating an example of a setting of a white point;

FIG. 17 is a schematic diagram illustrating an example of a case of correcting an input signal using the white point and the magnification of luminance;

FIG. 18 is a schematic diagram illustrating an example of calculation of luminance required to be supplemented;

FIG. 19 is a schematic diagram illustrating an example of processing for deriving the intensity of internal light for each unit of processing;

FIG. 20 is a schematic diagram illustrating an example of an arithmetic operation for determining the output signal;

FIG. 21 is a diagram illustrating an example of controlling the internal light and calculating a gradation value for each unit of processing;

FIG. 24 is a schematic diagram illustrating an example of calculating luminance required to be supplemented in the modification;

FIG. 26 is a schematic diagram illustrating an example of a case in which exception processing is required;

FIG. 27 is a diagram illustrating an example of a case in which FIG. 25 is expressed numerically;

FIG. 28 is a diagram illustrating an example of a case in which FIG. 26 is expressed numerically;

FIG. 29 is a diagram illustrating an example of an output gradation value in a case of receiving emitted light having light intensity corrected through the exception processing;

DETAILED DESCRIPTION

Figure 1:
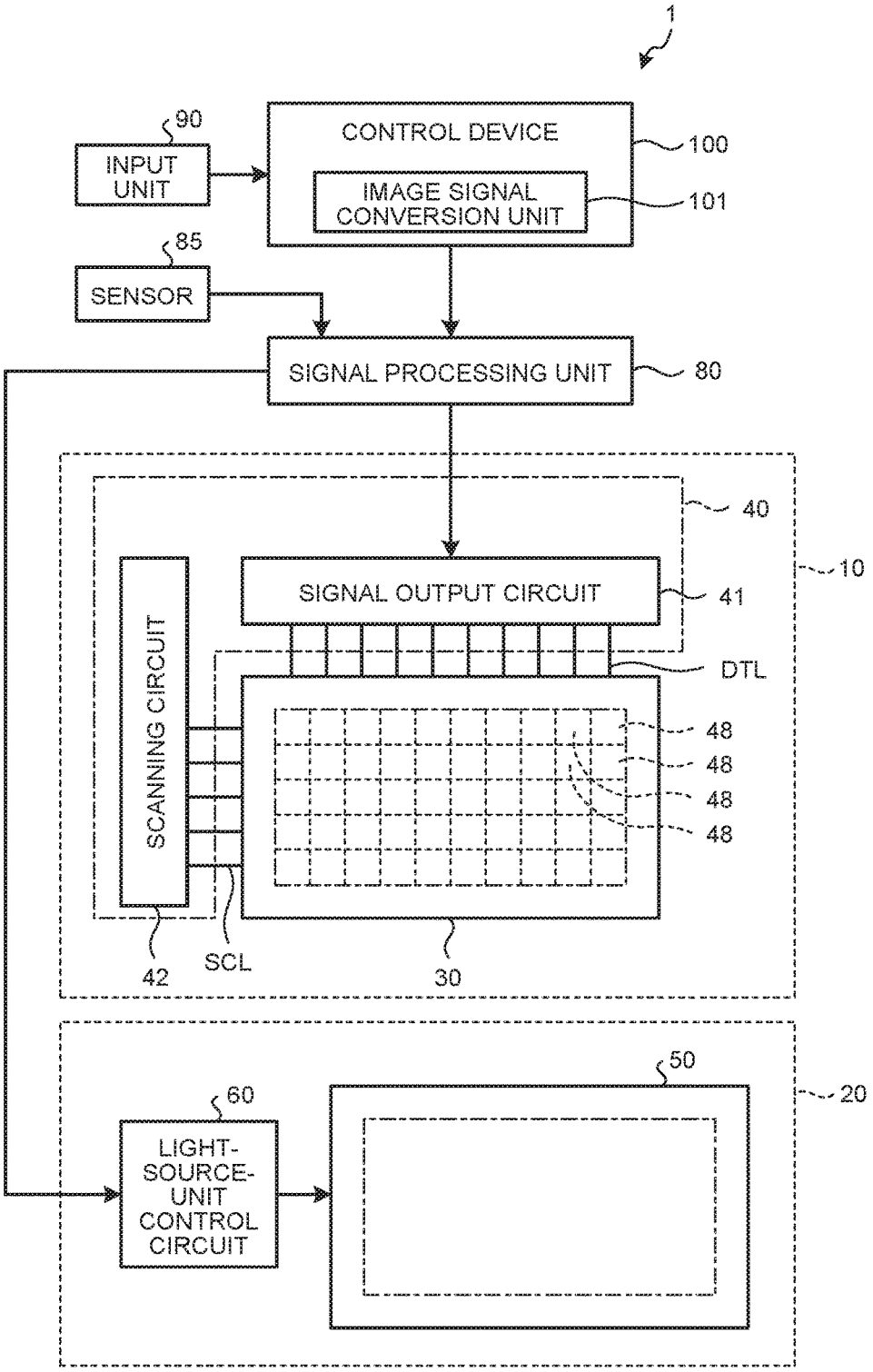
FIG. 1 is a block diagram illustrating an example of a main configuration of an electronic apparatus including a display device according to an embodiment.

The following describes an embodiment of the present disclosure with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

In this disclosure, when an element is described as being "on" another element, the element can be directly on the other element, or there can be one or more elements between the element and the other element.

Figure 2:
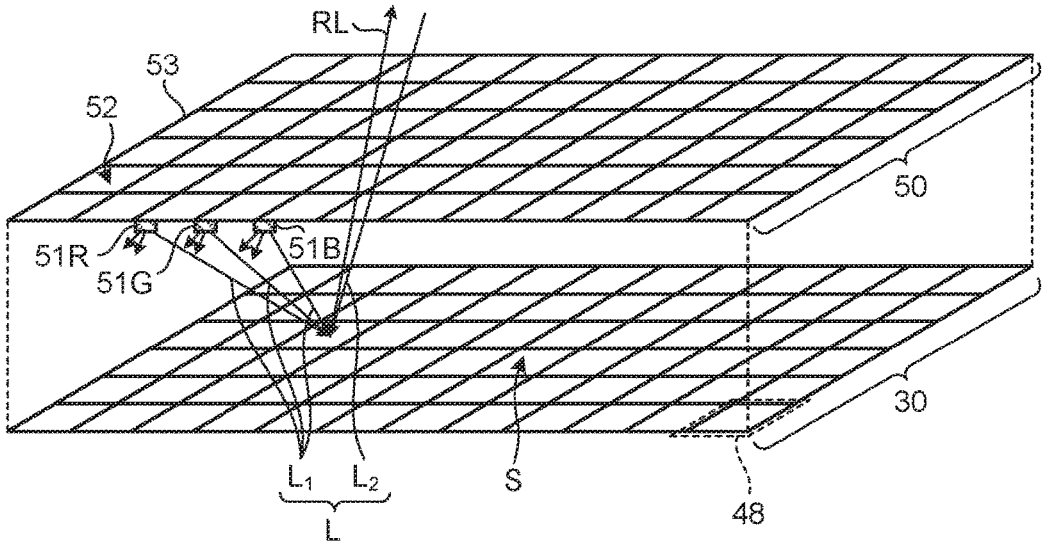
FIG. 2 is a schematic exploded perspective view of the display device including a lighting apparatus according to the embodiment.

FIG. 1 is a block diagram illustrating an example of a main configuration of an electronic apparatus 1 including a display device according to an embodiment. FIG. 2 is a schematic exploded perspective view of the display device. As illustrated in FIG. 1, the display device 1 includes a reflective display unit 10 including a plurality of sub-pixels 48, an illumination unit 20 that emits light to the display unit 10, a sensor 85 for measuring external light intensity, and a signal processing unit 80 functioning as a control unit for the display device. The electronic apparatus 1 including the display device also includes an input unit 90 for performing various inputs to the electronic apparatus 1, a control device 100 that performs various pieces of processing related to an operation of the electronic apparatus 1, and the like in addition to the display device.

The display device included in the electronic apparatus 1 is a reflective display device including the display unit 10 that includes a plurality of pixels (for example, unit pixels 45) that perform color reproduction combining outputs of the sub-pixels 48 of three or more colors including at least a first color, a second color, and a third color. The display unit 10 includes, for example, a display panel 30 and a display-panel drive circuit 40. The display panel 30 is a reflective display panel and performs video display using at least one of light emitted from the illumination unit 20 (internal light $L_1$) and light other than the light from the illumination unit 20 (external light $L_2$). The display panel 30 includes the sub-pixels 48 arranged in a two-dimensional matrix and a reflective display element arranged in each sub-pixel 48. The reflective display element may be, for example, an electrophoresis element, a liquid crystal element such as a liquid crystal on silicon (LCOS), a microelectromechanical systems (MEMS) element, an electrowetting element, an electrochromic element, or the like.

Figure 3:
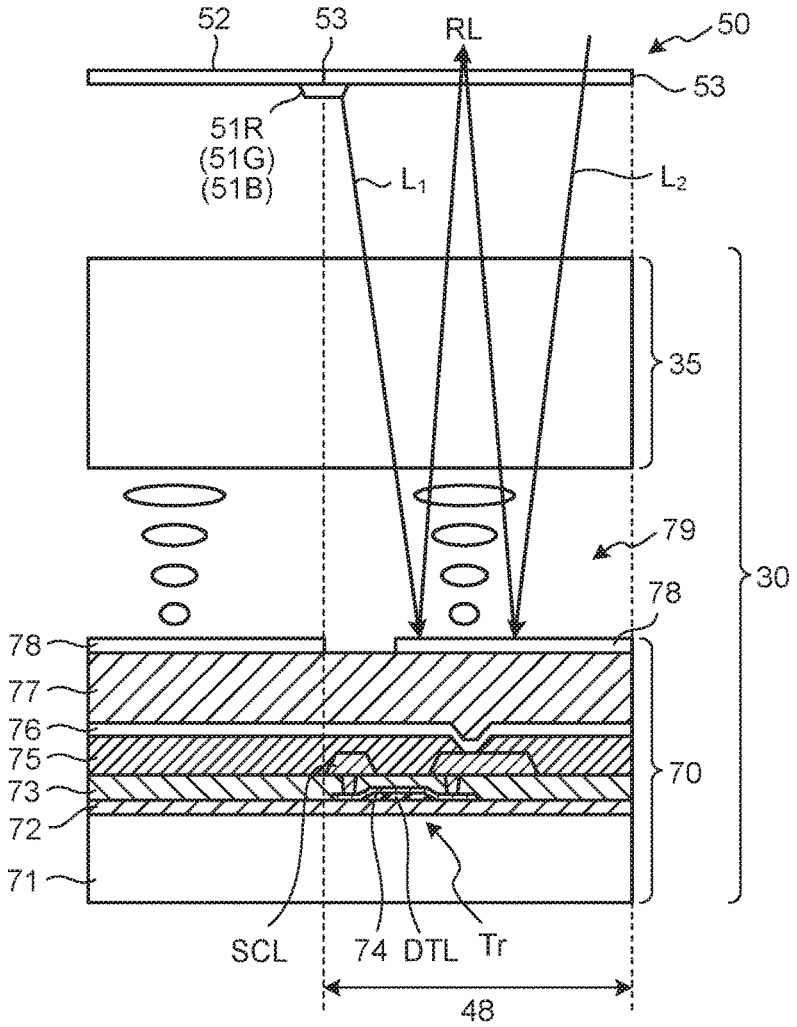
FIG. 3 is a diagram illustrating an example of a cross-sectional structure of a display panel and a light source unit.

FIG. 3 is a diagram illustrating an example of a cross-sectional structure of the display panel 30 and a light source unit 50. FIG. 3 illustrates an example of a cross-sectional structure in a case in which the reflective display element is a liquid crystal element including a liquid crystal layer 79. As illustrated in FIG. 3, the display panel 30 includes a first substrate (pixel substrate) 70, a second substrate (counter substrate) 35 arranged opposite the first substrate 70 in a direction perpendicular to a surface of the first substrate 70, and the liquid crystal layer 79 interposed between the first substrate 70 and the second substrate 35.

The first substrate 70 is obtained by forming various circuits on a translucent substrate 71 and includes a plurality of first electrodes (pixel electrodes) 78 arranged in a matrix on the translucent substrate 71 and a second electrode (common electrode) 76. The first electrode 78 and the second electrode 76 are insulated from each other by an insulating layer 77 and are opposed to each other in the direction perpendicular to a surface of the translucent substrate 71. Each of the first electrode 78 and the second electrode 76 is a translucent electrode formed of a translucent conductive material (translucent conductive oxide) such as indium tin oxide (ITO).

In the first substrate 70, a semiconductor layer 74 in which a transistor Tr serving as a switching element for the sub-pixel 48 is formed, and pieces of wiring such as a signal line DTL and a scanning line SCL are stacked on the translucent substrate 71. The signal line DTL supplies a pixel signal to the first electrode 78, and the scanning line SCL drives the transistor Tr. The semiconductor layer 74 and the pieces of wiring are insulated from each other by insulating layers 72, 73, and 75.

The first electrode 78 functions as a reflection unit that reflects entering light L (refer to FIG. 2) including the internal light $L_1$ and the external light $L_2$, and thereby reflected light RL thereof can be obtained. The intensity of the reflected light RL with respect to the intensity of the entering light L depends on the degree of modulation caused by the liquid crystal layer 79. That is, when orientation of liquid crystals in the liquid crystal layer 79 is controlled, the transmittance of light passing through the liquid crystal layer 79 is changed, and thereby the luminance of the sub-pixel 48 is controlled.

The configuration of the display panel 30 is not limited, and known devices can be used such as a reflective liquid crystal display panel and electronic paper (for example, an electrophoretic type). The display panel 30 includes, for example, a front panel including a transparent common electrode, a rear panel including the pixel electrode, and a liquid crystal material arranged between the front panel and the rear panel. In the display panel 30, a material that reflects light may be employed for the pixel electrode, or a translucent pixel electrode may be combined with a reflective film made of metal and the like so that the reflective film reflects light. In the present embodiment, an ECB mode that is one of longitudinal electric field modes is employed as a driving mode for liquid crystals. However, a TN mode or a VA mode may be employed as another longitudinal electric field mode. Alternatively, the liquid crystals may be driven in an IPS mode or an FFS mode as a horizontal electric field mode. For example, the display panel 30 may be configured to be a liquid crystal display panel including both of a reflective display region and a transmissive display region in the sub-pixel 48.

Figure 4:
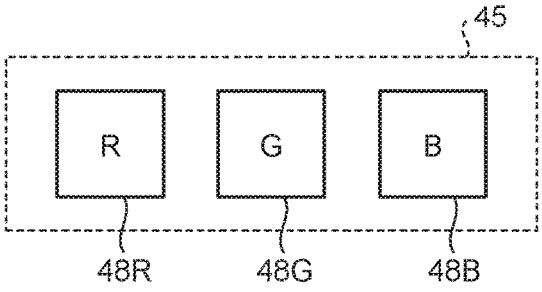
FIG. 4 is a diagram illustrating an example of a unit of color reproduction with a plurality of sub-pixels.

FIG. 4 is a diagram illustrating an example of a unit of color reproduction with a plurality of sub-pixels 48. In the present embodiment, each of the sub-pixels 48 is a sub-pixel that outputs one of at least the first color, the second color, and the third color, and the display unit 10 includes a pixel (for example, the unit pixel 45) that performs color reproduction by combining outputs of the sub-pixels 48. Specifically, each of the sub-pixels 48 is, for example, a sub-pixel that outputs any of red (R), green (G), and blue (B). The display unit 10 performs color reproduction in accordance with an RGB signal by combining outputs of a sub-pixel 48R of red (R), a sub-pixel 48G of green (G), and a sub-pixel 48B of blue (B). Hereinafter, a configuration obtained by combining the sub-pixels 48 for performing color reproduction in accordance with the RGB signal may be referred to as the unit pixel 45. The present embodiment describes a case in which one unit pixel 45 includes one sub-pixel 48R of red (R), one sub-pixel 48G of green (G), and one sub-pixel 48B of blue (B). However, this is merely an example of the configuration of the unit pixel 45. The embodiment is not limited thereto and can be modified as appropriate. In FIGS. 1 to 7, the sub-pixel 48 has a square shape. However, this is a schematic diagram, which does not illustrate an actual shape of the sub-pixel 48. The sub-pixel 48 can have a polygonal shape such as a rectangle or a quadrilateral. When the colors of the sub-pixels do not need to be distinguished from each other, the sub-pixels may be collectively referred to as the sub-pixels 48. Each of the sub-pixels 48 illustrated in FIGS. 1 and 2 is, for example, one of the sub-pixel 48R of red (R), the sub-pixel 48G of green (G), and the sub-pixel 48B of blue (B). As described above, in the present embodiment, the first color, the second color, and the third color are red (R), green (G), and blue (B), respectively.

The display unit 10 includes, for example, a plurality of sub-pixels 48 arranged in a matrix along two directions intersecting with each other along a plane (for example, the X-direction and the Y-direction orthogonal to each other). In the present embodiment, the sub-pixels 48 included in one unit pixel 45 are arranged along the X-direction. However, this is merely an example of the arrangement of the sub-pixels 48. The embodiment is not limited thereto, and can be modified as appropriate. In the display panel 30 according to the present embodiment, a plurality of unit pixels 45 are arranged in a matrix.

The shape of the display panel 30 is not limited. For example, the display panel 30 may have a horizontally long rectangular shape, or a vertically long rectangular shape. With the number M×N of the unit pixels 45 (pixels) of the display unit 10 being represented as (M, N) and the number of the sub-pixels 48 included in one unit pixel 45 being represented as D, for example, in a case in which the display panel 30 has a horizontally long rectangular shape, some resolutions for image display such as (640×D, 480), (800×D, 600), and (1024×D, 768) can be exemplified as values of (M, N), and in a case in which the display panel 30 has a vertically long rectangular shape, resolutions obtained by replacing the above values with each other can be exemplified.

At least part of the display panel 30 may have flexibility. In this case, for example, the display unit 10 includes a reflective display element including a plastic substrate, an electrophoresis element, and the like, and a driving element including an organic thin film transistor (TFT) and the like.

The display-panel drive circuit 40 includes a signal output circuit 41 and a scanning circuit 42. The display-panel drive circuit 40 causes the signal output circuit 41 to hold a video signal, and sequentially outputs the video signal to the display panel 30. The signal output circuit 41 is electrically coupled to the display panel 30 via the wiring DTL. The scanning circuit 42 is electrically coupled to the display panel 30 via the wiring SCL. The signal output circuit 41 appropriately outputs an output signal output from the signal processing unit 80 in synchronization with the scanning circuit 42 that controls ON/OFF of a switching element (for example, a TFT) for controlling an operation (light transmittance) according to the gradation value of the sub-pixel in the display panel 30. The scanning circuit 42 turns on the switching element of the sub-pixel 48 coupled to the wiring SCL corresponding to a position of the sub-pixel 48 indicated by the output signal output from the signal processing unit 80.

The illumination unit 20 includes, for example, the light source unit 50 and a light-source-unit control circuit 60. The light source unit 50 is arranged opposite a display surface S of the display panel 30, emits light to the surface, and transmits reflected light from the display surface. That is, the light source unit 50 is a front light that emits the internal light $L_1$ to the display surface S of the display panel 30. The light source unit 50 includes light emitting units 51 such as a first light source 51R that emits light in the first color to the display unit, a second light source 51G that emits light in the second color to the display unit, and a third light source 51B that emits light in the third color to the display unit. Each of the first light source 51R, the second light source 51G, and the third light source 51B is a self-luminous element arranged on a translucent substrate, for example. The translucent substrate may be a translucent substrate made of glass and various plastic materials (for example, PMMA, a polycarbonate resin, an acrylic resin, an amorphous polypropylene resin, and a styrene resin including an AS resin). Each of the first light source 51R, the second light source 51G, and the third light source 51B may be, for example, an organic electric field light-emitting element (organic electroluminescence (EL) element), an inorganic electric field light-emitting element (inorganic EL element), an organic light emitting diode (OLED), and a micro light emitting diode (MicroLED). The first light source 51R, the second light source 51G, and the third light source 51B emit light toward the display surface S of the display panel 30. To conceptually describe characteristics of the present invention, the colors of light from the first light source 51R, the second light source 51G, and the third light source 51B are represented as "internal light $L_1$" for convenience. When the colors from an emitting unit need to be distinguished from each other, the first light source 51R, the second light source 51G, and the third light source 51B are independently described.

The light source unit 50 includes an opening 52 formed corresponding to a region (pixel region) of the sub-pixel 48 of the display panel 30, and a grid-like light shielding part 53 arranged in a region (inter-pixel region) between the sub-pixels 48 in the display panel 30. The light shielding part 53 functions as a black matrix (BM), and is made of a predetermined black resin material, for example. As illustrated in FIG. 2, the internal light $L_1$ enters the liquid crystal layer 79 as part or the whole of the entering light L, and is reflected from the first electrode 78 to be emitted as the reflected light RL. Specifically, as illustrated in FIG. 4, the external light $L_2$ and the internal light $L_1$ passing through the opening 52 are emitted as the reflected light RL. The intensity of such reflected light RL depends on the light transmittance of the liquid crystal layer 79 that is determined under control of the signal processing unit 80.

Figure 5:
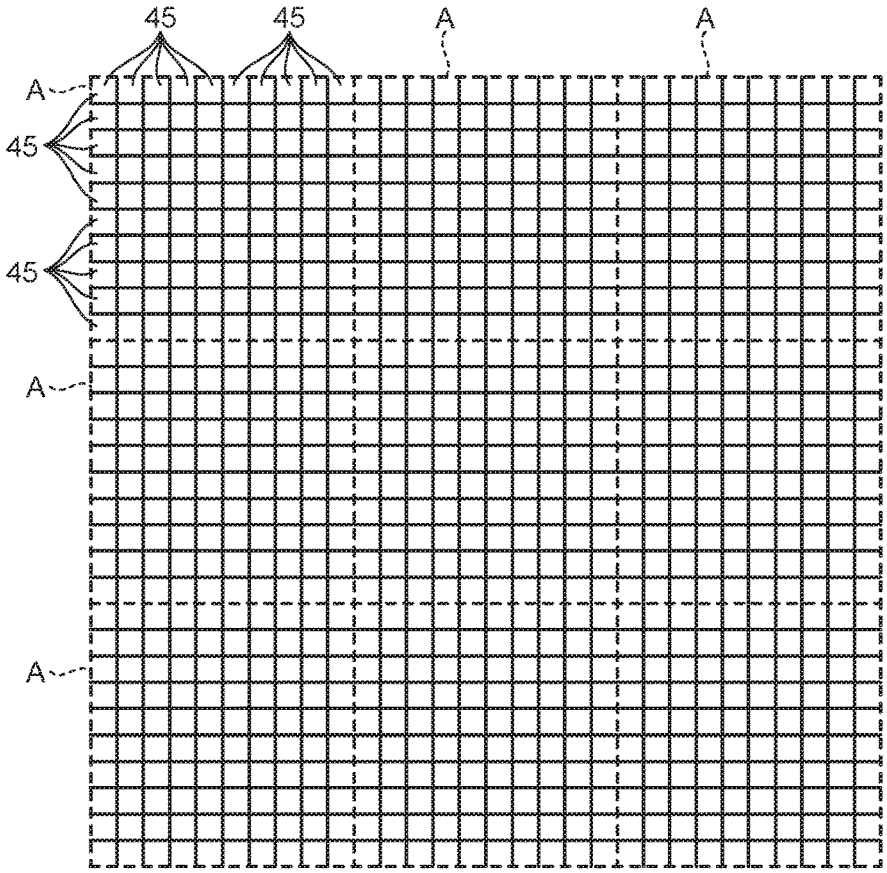
FIG. 5 is a diagram illustrating an example of a relation between a partial region and a unit pixel.

FIG. 5 is a diagram illustrating an example of a relation between a partial region and the unit pixel 45. In the present embodiment, the display unit 10 includes a plurality of partial regions each including a plurality of sub-pixels 48, and the illumination unit 20 includes a plurality of light emitting regions each of which independently emits light to each of the partial regions. Each of the light emitting regions can independently control the intensity of light from the first light source 51R, the second light source 51G, and the third light source 51B. Specifically, the display panel 30 according to the present embodiment includes the partial regions as control units of the output signal under the control of the signal processing unit 80. Each of the partial regions includes a plurality of (for example, X×Y=10×10) unit pixels 45. In FIG. 5, one rectangle indicated by a solid line represents one unit pixel 45, and one rectangle indicated by a dashed line represents one partial region. Each of the light emitting regions of the light source unit 50 includes at least one of the first light source 51R, the second light source 51G, and the third light source 51B. The illumination unit 20 is arranged so that each of the partial regions included in the display panel 30 can be independently irradiated with light emitted from each of the light emitting regions. In the following description, a combination of one of the partial regions and the light emitting region that emits light to the one partial region may be referred to as one unit of processing in some cases.

The light-source-unit control circuit 60 controls an amount and the like of the light output from the light source unit 50. Specifically, the light-source-unit control circuit 60 adjusts a duty ratio or a voltage supplied to the first light source 51R, the second light source 51G, and the third light source 51B arranged in each of the light emitting regions included in the light source unit 50 based on a light emitting region control signal output from the signal processing unit 80 to control the intensity of the light emitted to each of the partial regions from the first light source 51R, the second light source 51G, and the third light source 51B.

The sensor 85 measures the intensity of the color component of each of the first color, the second color, and the third color included in the light (external light $L_2$) that is not from the illumination unit 20 out of the light emitted to the display unit 10. Specifically, the sensor 85 has a configuration that generates an output corresponding to the detected light intensity (for example, a photodiode), a circuit that converts such an output into numbers and data to be output, and the like. The sensor 85 may further include a configuration for dispersing light such as a filter. The sensor 85 may split the external light $L_2$ into pieces of light in colors corresponding to part or all of the colors of the sub-pixels 48 in the display unit 10 to measure the intensity of the light in each color. The sensor 85 according to the present embodiment independently measures the intensity of light in a spectrum of each of red (R), green (G), and blue (B).

The signal processing unit 80 includes, for example, an integrated circuit such as a field-programmable gate array (FPGA). The integrated circuit functions as an arithmetic unit including an integrated circuit and the like, a storage unit that stores various pieces of data related to an arithmetic operation performed by the arithmetic unit, and the like. The signal processing unit 80 performs arithmetic operation of an output signal for each pixel to be supplied to the display unit 10 and an output signal for adjusting brightness and the like of each light emitting unit 51 to be supplied to the illumination unit 20 based on brightness of a screen set via the input unit 90 and external light intensity measured by the sensor 85, for example.

The input unit 90 includes, for example, a touch panel sensor integrated with the display unit 10 and/or a switch provided to the electronic apparatus 1. The user can perform various inputs related to the operation of the electronic apparatus 1 through an operation on the input unit 90. As a specific example, the user can perform a setting and the like related to the brightness of the screen in image display performed by the display unit 10 by performing the operation on the input unit 90.

The control device 100 includes, for example, an integrated circuit such as an FPGA. The integrated circuit functions as an arithmetic unit that performs various pieces of arithmetic processing related to a display output, a storage unit that stores various pieces of data related to the arithmetic operation performed by the arithmetic unit, and the like. The control device 100 functions as, for example, an image signal conversion unit 101 that converts a plurality of pixel values (gradation values) constituting data of an image to be displayed by the display device into an input signal to be input to the display device. The input signal is, for example, the RGB signal, and includes information indicating gradation values of the sub-pixel 48R of red (R), the sub-pixel 48G of green (G), and the sub-pixel 48B of blue (B) for each unit pixel 45. The image signal conversion unit 101 outputs the input signal to the signal processing unit 80.

Figure 6:
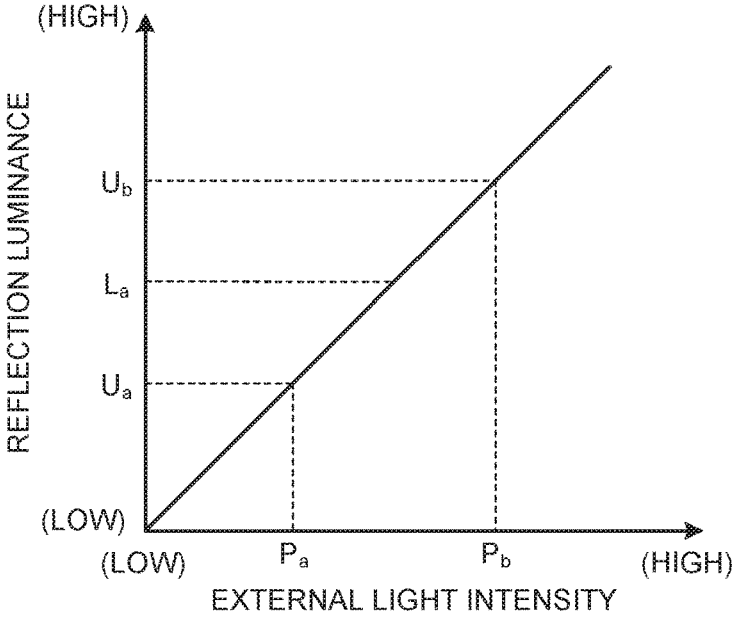
FIG. 6 is a schematic diagram illustrating a relation between external light intensity and reflection luminance at the time when the highest gradation values of a unit pixel are output.

The following describes the display device according to the present embodiment in more detail. First, the following simply describes a relation between predetermined reflection luminance, and the external light $L_2$ and the internal light $L_1$. FIG. 6 is a schematic diagram illustrating a relation between the external light intensity and the reflection luminance at the time when the highest gradation values of the unit pixel 45 are output. In the present embodiment, when the highest gradation values of the unit pixel 45 are output, that is, when an output corresponding to the input signal of (R, G, B)=(255, 255, 255) is performed, the unit pixel 45 is caused to be in a "white display state" that outputs white having the highest luminance. In this case, "white display" indicates display obtained by outputting (R, G, B)=(255, 255, 255) without correction, and the display is not influenced by a color ratio defined by a white point (described later). FIG. 6 illustrates a relation between the external light intensity and the reflection luminance of the sub-pixel 48 in the white display state with the line P and illustrates the reflection luminance of $U_a$ and $U_b$ at the external light intensities of $P_a$ and $P_b$ as specific two patterns. The external light intensities of $P_a$ and $P_b$ satisfies $P_a<P_b$, and the reflection luminance of $U_a$ and $U_b$ satisfies $U_a<L_a<U_b$. Hereinafter, description is provided with reference to FIGS. 7 to 10 assuming that the reflection luminance $L_a$ is desired to be obtained in the white display state.

Figure 7:
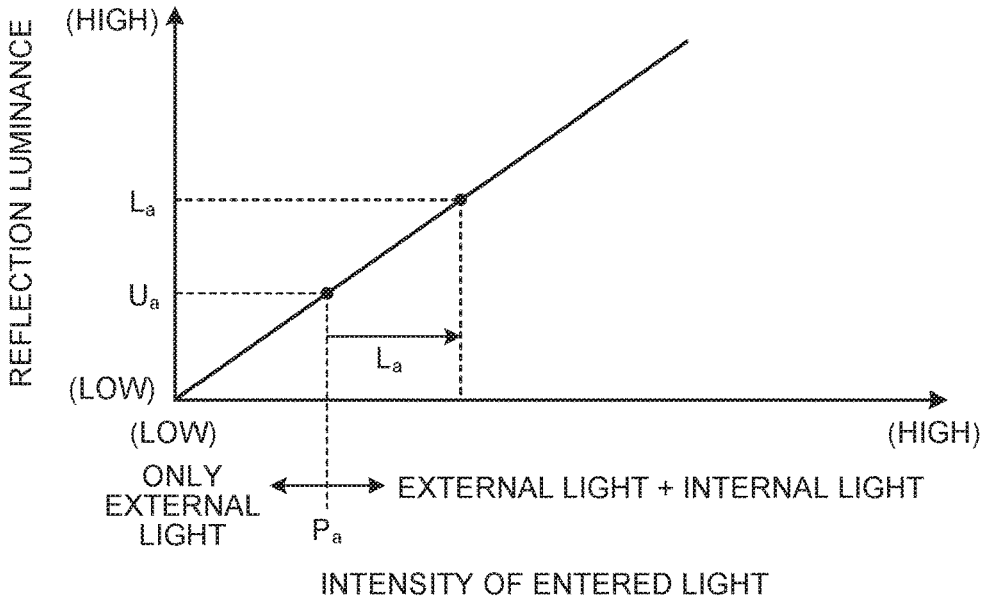
FIG. 7 is a diagram illustrating an example of control performed when external light intensity required for obtaining predetermined reflection luminance is not obtained.
Figure 8:
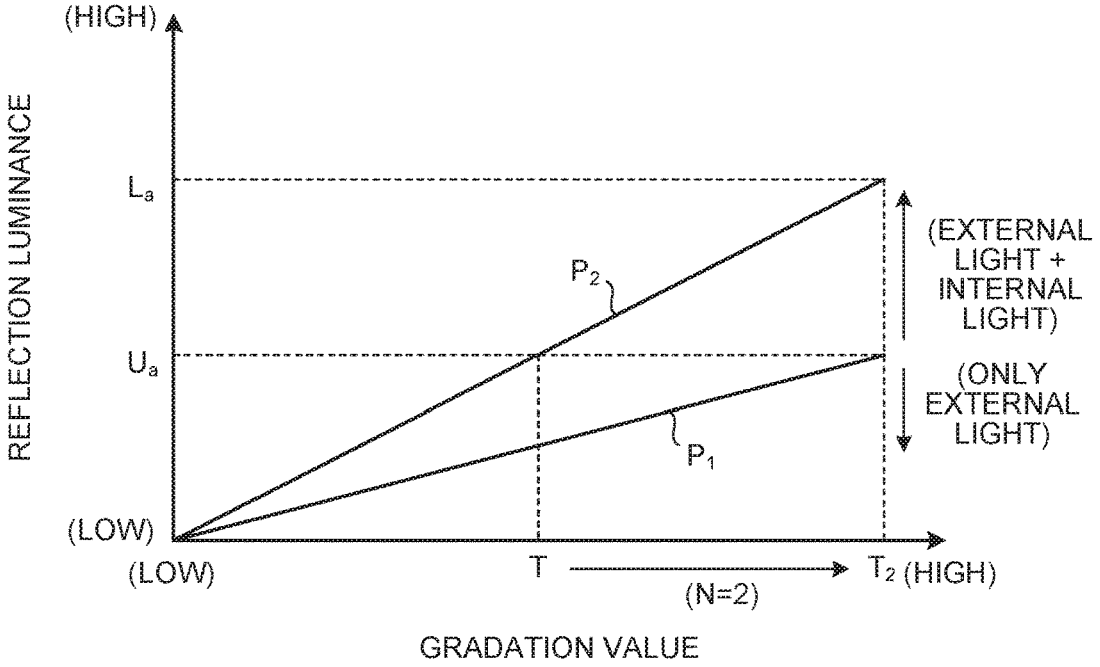
FIG. 8 is a diagram illustrating an example of control performed when the external light intensity required for obtaining predetermined reflection luminance is not obtained.
Figure 9:
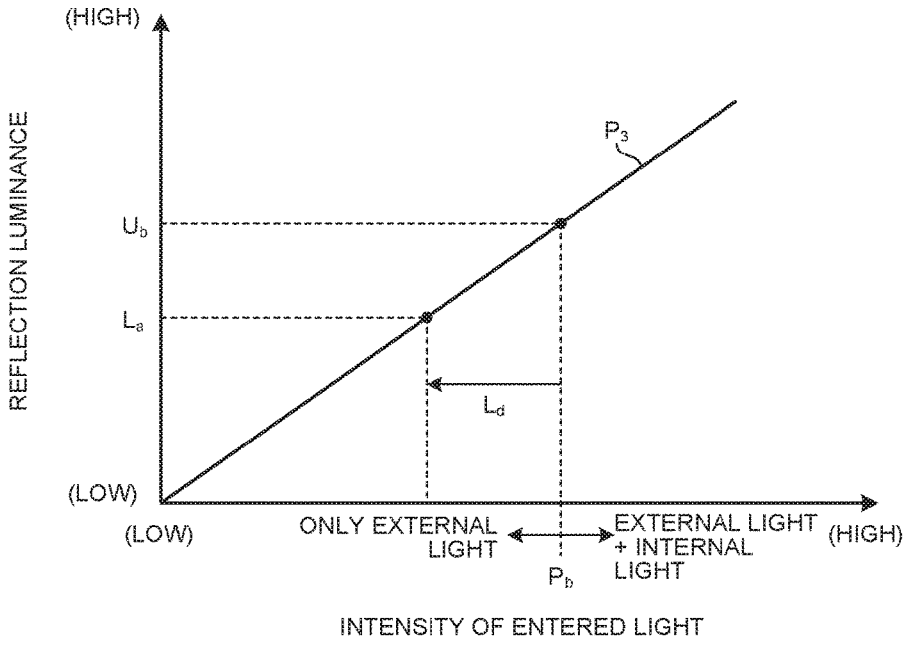
FIG. 9 is a diagram illustrating an example of control performed when the external light intensity is extremely high with respect to the predetermined reflection luminance.
Figure 10:
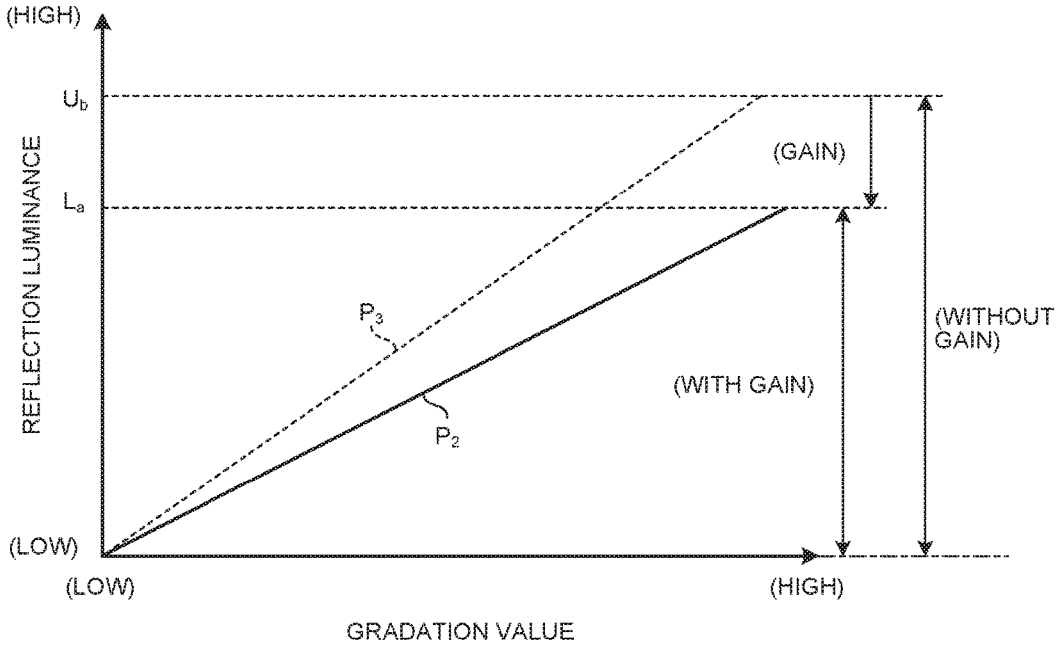
FIG. 10 is a diagram illustrating an example of control performed when the external light intensity is extremely high with respect to the predetermined reflection luminance.

FIGS. 7 and 8 are diagrams illustrating an example of control performed when the external light intensity required for obtaining predetermined reflection luminance is not obtained. FIGS. 9 and 10 are diagrams illustrating an example of control performed when the external light intensity is extremely high with respect to the predetermined reflection luminance. The predetermined reflection luminance may be, for example, reflection luminance corresponding to brightness of the screen set by the user using the electronic apparatus 1, or reflection luminance with which the user who uses the electronic apparatus 1 statistically feels that the screen is easy to view. Hereinafter, description is provided with reference to FIGS. 7 to 10 assuming that the reflection luminance $L_a$ is desired to be obtained in the white display state.

For example, as illustrated in FIG. 7, the display unit 10 may possibly fail to secure the predetermined reflection luminance $L_a$ with the reflection luminance $U_a$ obtained from only the external light $L_2$. In this case, the signal processing unit 80 performs signal processing for emitting light having intensity corresponding to luminance deficiency $L_u$ to the display region using the light emitting unit 51. Through the signal processing, the light having intensity required as the reflection luminance can be emitted to the reflective electrode.

In a case of the example illustrated in FIG. 8, due to a gradation characteristic $P_1$ of the unit pixel 45 obtained with only the external light $L_2$, the reflection luminance $U_a$ can be obtained in the white display state. That is, to obtain reflection luminance higher than the reflection luminance $U_a$ (for example, the reflection luminance $L_a$), the intensity of the entering light L needs to be increased by emitting the internal light $L_1$ to the display panel 30 in addition to the external light $L_2$. Thus, when the gradation value that requires reflection luminance higher than the reflection luminance $U_a$ is output under a condition of the external light $L_2$ as illustrated in FIG. 8, the light emitting unit 51 is lit. When the light emitting unit 51 is lit to emit light having the intensity corresponding to the luminance $L_u$ illustrated in FIG. 7, the gradation characteristic of the unit pixel 45 is caused to be a gradation characteristic $P_2$ that has higher reflection luminance corresponding to the gradation value than that of the gradation characteristic $P_1$ and that can obtain the reflection luminance $L_a$ in the white display state.

In the example illustrated in FIG. 8, the gradation value for outputting the reflection luminance $U_a$ with the gradation characteristic $P_2$ is denoted by a sign T. However, the reflection luminance $U_a$ can be output with the entering light L obtained from only the external light $L_2$ by setting the gradation value as the gradation value in the white display state without causing the light emitting unit 51 to be lit. Of course, the output of the reflection luminance $U_a$ may be obtained by performing output of the gradation value T while the light emitting unit 51 causes the unit pixel 45 to exhibit the gradation characteristic $P_2$. To obtain the output of the reflection luminance $U_a$, one of the following operations is performed: control of the gradation value, lighting of the light emitting unit 51, and control of the gradation value assuming that both the control of the gradation value and the lighting the light emitting unit 51 are performed. Which operation is to be performed is determined based on the reflection luminance $U_1$ required for outputting another unit pixel 45 sharing the light emitting unit 51. For example, when the unit pixel 45 that requires the reflection luminance $U_a$ for output and the unit pixel 45 that requires the reflection luminance $L_a$ for output are under the influence of the same light emitting unit 51, the light emitting unit 51 is lit for the unit pixel 45 that requires the reflection luminance $L_a$, so that the unit pixel 45 that requires the reflection luminance $U_a$ is controlled to output the gradation value T. When only the unit pixels 45 that require reflection luminance equal to or lower than the reflection luminance $U_a$ are under the influence of the same light emitting unit 51, each unit pixel 45 can obtain the reflection luminance required for output by independently controlling the gradation value for each unit pixel 45 without causing the light emitting unit 51 to be lit.

As illustrated in FIG. 9, when the reflection luminance $U_b$ is obtained because the external light intensity is extremely high with respect to the predetermined reflection luminance $L_a$ without controlling the output (gradation value) of the sub-pixel 48, the gradation characteristic of the unit pixel 45 becomes a gradation characteristic $P_3$. As illustrated in FIG. 10, when the reflection luminance $U_b$ is higher than the predetermined reflection luminance $L_a$, the gradation characteristic $P_3$ is deviated from the gradation characteristic $P_2$ in a case of the predetermined reflection luminance $L_a$. In such a case, the signal processing unit 80 lowers the reflectivity of the display region by applying a gain to the output to lower the output of the unit pixel 45 in accordance with an excess $L_d$ of the external light intensity and can thereby reduce the reflection luminance to the predetermined reflection luminance $L_a$. The expression of "lowers the reflectivity" means to lower light transmittivity of the reflective display element (for example, the sub-pixel 48 included in the unit pixel 45) by reducing the gradation value of the unit pixel 45 to lower the intensity of the reflected light RL. Specifically, as illustrated in FIG. 10 for example, when the signal processing unit 80 applies a gain to the output, the reflection luminance corresponding to the gradation value in the unit pixel 45 is adjusted to be lower than that of the gradation characteristic $P_3$ in a state in which no gain applied to the output. Due to this, the gradation characteristic $P_2$ in a case of the predetermined reflection luminance $L_a$ can be obtained.

In this way, the signal processing unit 80 controls the operation of the light emitting unit 51, controls the output (gradation value) of each sub-pixel 48, or controls both of them. Thus, the display panel 30 can perform image display with the predetermined reflection luminance $L_a$.

Figure 11:
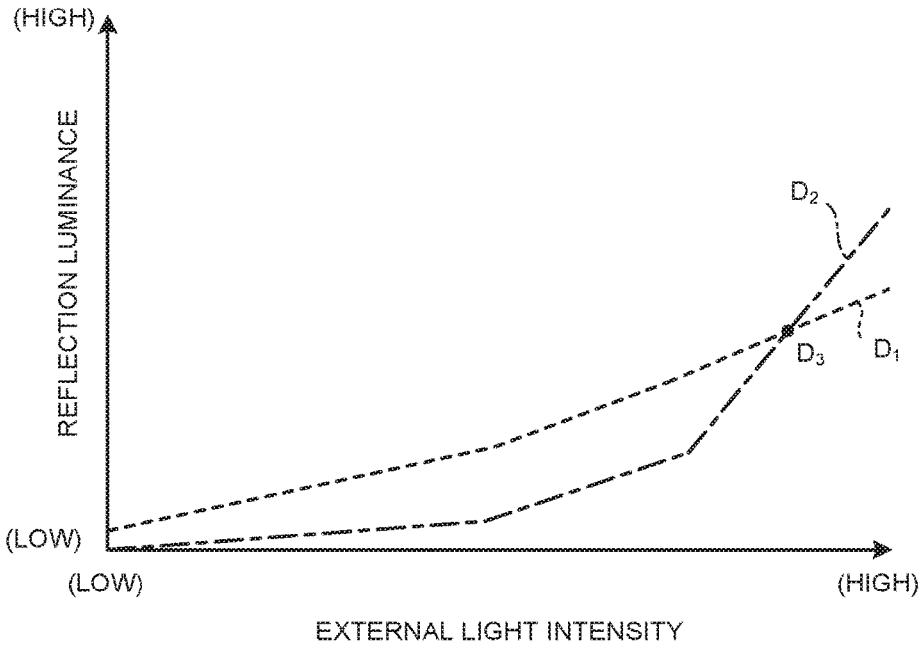
FIG. 11 is a graph illustrating an example of a correspondence relation between the external light intensity, and the reflection luminance and exemplary luminance.

FIG. 11 is a graph illustrating an example of a correspondence relation between the external light intensity, and reflection luminance $D_1$ and exemplary luminance $D_2$. An example of the reflection luminance with which the user feels that the screen is easy to view (described as the exemplary luminance) varies depending on the external light intensity as indicated by the exemplary luminance $D_2$ illustrated in FIG. 11, for example. This is because the output from the display unit 10 looks relatively brighter as the surrounding area becomes darker. Thus, even when the brightness of the screen set by the user using the electronic apparatus 1 is under a specific condition of external light intensity, the signal processing unit 80 may control the exemplary luminance $D_2$ variably in accordance with the external light intensity as illustrated in FIG. 11. By setting the exemplary luminance $D_2$ to be the "predetermined reflection luminance $L_a$" described above, the electronic apparatus 1 can perform display output with the brightness of the screen corresponding to the external light intensity. Naturally, the signal processing unit 80 may perform control to keep the luminance set by the user irrespective of the external light intensity.

The output of the display unit 10 becomes brighter as the external light intensity increases, and the exemplary luminance $D_2$ becomes equal to or higher than the reflection luminance $D_1$ when the external light intensity exceeds a certain threshold (for example, external light intensity corresponding to an intersecting point $D_3$ of the reflection luminance $D_1$ and the exemplary luminance $D_2$ illustrated in FIG. 11). Under the environment in which the external light intensity equal to or higher than the above threshold is obtained, the signal processing unit 80 does not cause the light emitting unit 51 to operate. Under the environment in which the external light intensity is lower than the above threshold, the signal processing unit 80 causes the light emitting unit 51 to operate.

Figure 12:
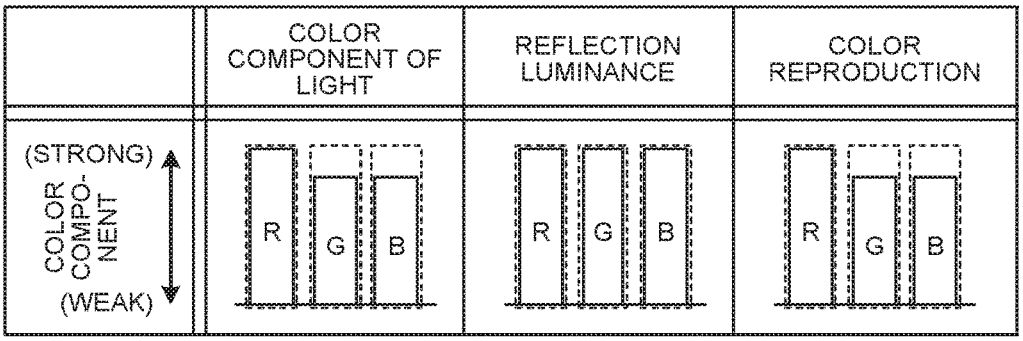
FIG. 12 is a schematic diagram illustrating an example of a correspondence relation between color components of light and color reproduction performed by the display device.
Figure 13:
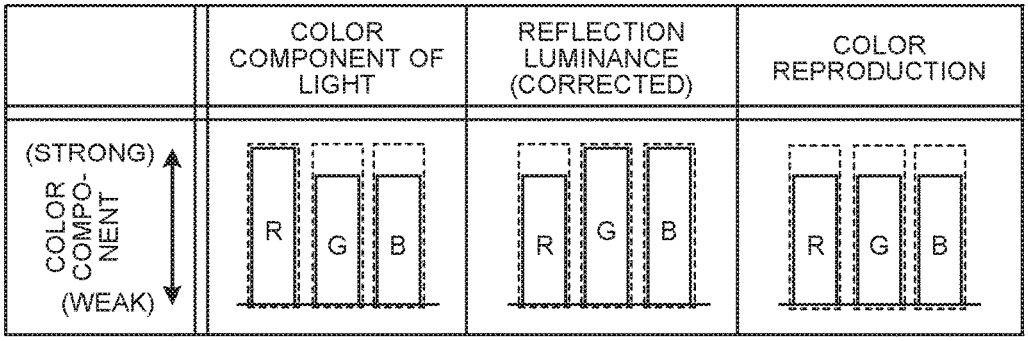
FIG. 13 is a schematic diagram illustrating an example of a correspondence relation between deviation in the color components of light, correction of an output signal, and color reproduction performed by the display device.

FIG. 12 is a schematic diagram illustrating an example of a correspondence relation between color components of light and color reproduction performed by the display device. FIG. 13 is a schematic diagram illustrating an example of a correspondence relation between deviation in the color components of light, correction of the output signal, and color reproduction performed by the display device. FIG. 12 and other figures illustrate a frame of a dashed line indicating the maximum value (255) of the gradation value expressed in 8 bits. When the output signal is not corrected, the display device performs color reproduction in accordance with a panel characteristic of the display panel 30 and the deviation in the color components of light. Specifically, as illustrated in FIG. 12 for example, when there is deviation in the color components of red (R), green (G), and blue (B) included in light emitted to the display panel 30 (for example, the external light $L_2$), and the degree of reflection of these color components on the display panel 30, that is, the light transmittance of the reflective display element is uniform, the display device performs color reproduction in accordance with the deviation in the color components of light. This means that the color reproduction depends on the deviation in the color components of light. For example, light emitted from an external light source such as an incandescent light bulb provided around the electronic apparatus 1 corresponds to light in which the color component of red (R) is relatively stronger than the color components of green (G) and blue (B) as indicated by "color components of light" illustrated in FIGS. 12 and 13. Based on such light, when the reflective display element performs display output with the maximum transmittance so that the entering light L is reflected in the normal white display state ((R, G, B)=(255, 255, 255)) as indicated by "reflection luminance" illustrated in FIG. 12, a strength relation between the "color components of light" is directly reflected as an output of white as indicated by "color reproduction" illustrated in FIG. 12. In this case, by correcting the gradation value of the output signal to correct the deviation in the color components of light as indicated by "reflection luminance (corrected)" illustrated in FIG. 13, the display device can reduce the influence of the deviation in the color components of light in the color reproduction as indicated by "color reproduction" illustrated in FIG. 13. Specifically, for example, the display device corrects the gradation value of the sub-pixel 48 corresponding to the color components by converting a ratio of the color components of red (R), green (G), and blue (B) included in the light into numerical form and multiplying the gradation values by the reciprocal of the numerical ratio, and thus can perform color reproduction independently of the deviation in the color components of light.

Figure 14:
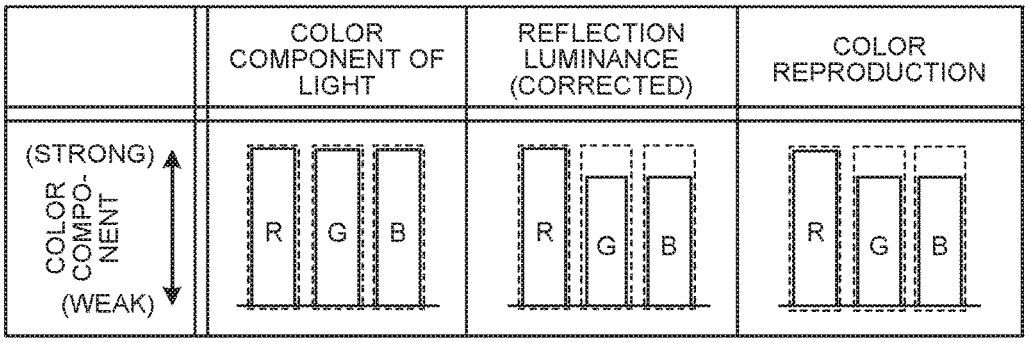
FIG. 14 is a schematic diagram illustrating an example of a case of causing color reproduction performed by the display device to correspond to a ratio of the color components included in specific external light even when there is no deviation in the color components of the external light.

FIG. 14 is a schematic diagram illustrating an example of a case of causing color reproduction performed by the display device to correspond to the ratio of the color components included in the specific external light $L_2$ even when there is no deviation in the color components of the external light $L_2$. In the description with reference to FIG. 13, correction is performed to reduce the influence of the deviation in the color components included in the external light $L_2$. In contrast, as illustrated in FIG. 14 for example, the color reproduction performed by the display device may be caused to correspond to a ratio of the color components included in light having a specific ratio of the color components. Specifically, the display device does not correct the gradation value under the condition in which only the external light $L_2$ is emitted to the display panel 30 (refer to FIG. 12). By contrast, the display device corrects the gradation value of the output signal under the condition in which the light having a ratio of the color component different from that of the external light $L_2$ is emitted. In the correction, the reflection luminance of each pixel is corrected so that the ratio of the color components becomes the same as that of the external light $L_2$. Thus, the display device can cause the color reproduction performed by the display device to correspond to the ratio of the color components included in the external light $L_2$ (refer to FIG. 14). The signal processing unit 80 of the display device can perform control similarly to the example illustrated in FIG. 14 for light from one or more predetermined light sources, not limited to the external light $L_2$. The light emitted to the display panel 30 is not limited to the light from a single light source, and may be mixed light in pieces of light from a plurality of light sources. For example, both of the external light $L_2$ and light from the front light (internal light $L_1$) may be emitted to the display panel 30. In this case, the signal processing unit 80 can performs color reproduction by applying a correction expression to the gradation value of the output signal, the correction expression taking account of the ratio of the color components of such pieces of light and an intensity ratio between the internal light $L_1$ and the external light $L_2$.

In the description with reference to FIGS. 6 to 14, a white display output is exemplified for simplification. The same mechanism can also be used for controlling the gradation value of each of the sub-pixels 48 included in the unit pixel 45 in outputting other colors.

The light intensity in the present embodiment is represented by a numerical value equal to or larger than 0. The intensity that provides reflection luminance corresponding to the gradation value indicated by the output signal for the sub-pixel 48 of the display unit 10 is assumed to be 1. That is, for example, light intensity at which the sub-pixel 48 of a certain color controlled with the gradation value of 255 can be output with luminance indicated by the gradation value of 255 is assumed to be 1. In other words, when the light intensity is 1, the maximum luminance that can be obtained with that light is an upper limit of the number of bits (for example, 255 in a case of 8 bits) of the gradation value indicated by the output signal.

Figure 15:
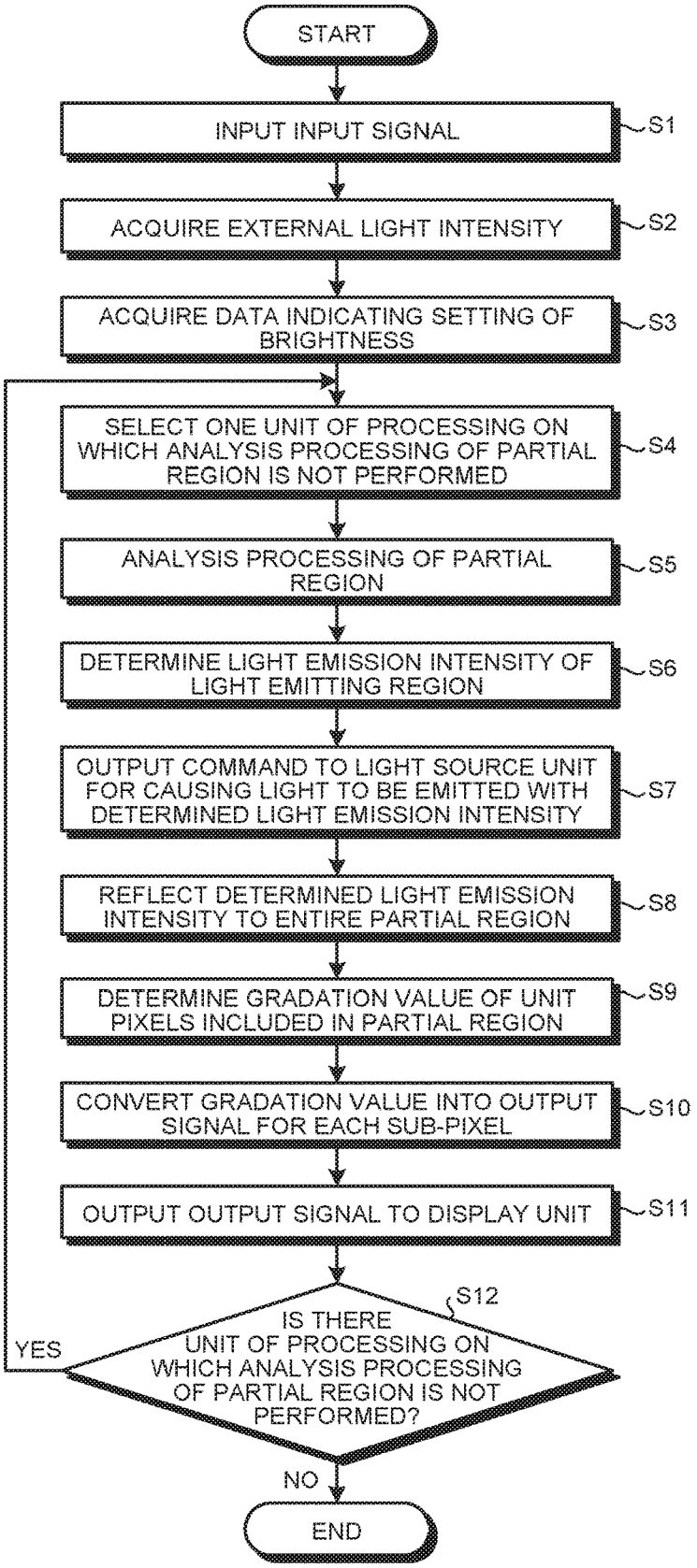
FIG. 15 is a flowchart illustrating an example of a processing procedure of a display output for one frame performed by a signal processing unit.

FIG. 15 is a flowchart illustrating an example of a processing procedure of a display output for one frame performed by the signal processing unit 80. If receiving the input signal (Step S1), the signal processing unit 80 acquires external light intensity measured by the sensor 85 (Step S2). The signal processing unit 80 also acquires data indicating the setting of brightness (Step S3). For example, when the user has performed a setting related to the brightness of the screen, the data indicating the setting of brightness reflects the setting performed by the user. When the user has not performed the setting related to the brightness of the screen, the data indicating the setting of brightness reflects a predetermined default setting. The default setting is a setting for obtaining the reflection luminance with which the user who visually recognizes the display unit 10 statistically feels that the screen is easy to view, for example. However, this is merely an example of the default setting. The embodiment is not limited thereto, and can be changed as appropriate. The processes at Steps S1 to S3 may be performed in a different order, or performed in parallel. The data indicating the settings is stored in a storage unit included in the signal processing unit 80, for example, but this is merely an example of a specific method for storing the settings. The embodiment is not limited thereto, and can be changed as appropriate. For example, the data indicating the settings may be stored in a storage unit of the control device 100, or a dedicated storage device may be provided for storing the data indicating the settings.

After the processes at Steps S1 to S3, the signal processing unit 80 selects one unit of processing on which analysis processing of a partial region is not performed (Step S4). The signal processing unit 80 performs analysis processing on the partial region for the one unit of processing selected in the process at Step S4 (Step S5). The analysis processing is based on the setting of brightness and the gradation value indicated by the input signal for each of the unit pixels 45 included in one partial region, and especially related to specifying the sub-pixel 48 in which the brightest output is performed in the partial region in the present embodiment. Based on the result of the processing at Step S5, the signal processing unit 80 determines the light emission intensity in the light emitting region for one unit of processing selected in the process at Step S4 (Step S6). The signal processing unit 80 outputs, to the illumination unit 20, a command (light emitting region control signal) to cause the light emitting region in one partial region selected in the process at Step S4 to emit light with the light emission intensity determined at Step S6 (Step S7). The brightness of the front light and the degree of expansion of each pixel, which are obtained in accordance with the process at Step S7, are uniformly reflected in the entire partial region including the pixel in which the brightest output is performed (Step S8).

The signal processing unit 80 determines the gradation values (for example, R, G, and B) of each of the unit pixels 45 included in the partial region for one unit of processing selected in the process at Step S4 based on the input signal received at Step S1 and the result of the processing performed at Step S6 (Step S9). The signal processing unit 80 converts the gradation value determined in the process at Step S9 into the output signal for each sub-pixel (for example, the output signal of R, G, or B) (Step S10), and outputs the output signal to the display unit 10 (Step S11). The processes at Step S7 and from Steps S9 to S11 may be performed in a different order, or performed in parallel. The process at Step S7 and the process at Step S11 are preferably performed at the same time, or even when there is a time difference between their processing timings, the time difference is preferably small so that the user who visually recognizes the display output from the display device does not feel the time difference in the processes.

The signal processing unit 80 determines whether there is a unit of processing on which analysis processing of the partial region is not performed (Step S12). If it is determined that there is a unit of processing on which analysis processing of the partial region is not performed (Yes at Step S12), the signal processing unit 80 performs the processing at Step S4 again. If it is determined that there is no unit of processing on which analysis processing of the partial region is not performed (No at Step S12), the signal processing unit 80 ends the process for the display output of one frame.

With reference to FIGS. 16 to 20, the following sequentially describes the setting of the white point in accordance with a measurement result of the external light $L_2$ (up to Step S2), determination of the intensity of the internal light $L_1$ for each unit of processing based on the intensity of the external light $L_2$ and the magnification (N) of the luminance (up to Step S7), and adjustment of the gradation value of the sub-pixel 48 in accordance with the intensity of the external light $L_2$ and the internal light $L_1$ (up to Step S10). FIG. 16 is a schematic diagram illustrating an example of the setting of the white point. For example, as illustrated in FIG. 16, definition of white using the gradation values of the RGB signal indicated by the input signal is assumed to be (R, G, B)=(255, 255, 255). The ratio of the color components in the definition of white is red (R):green (G):blue (B)=1:1:1. To cause the ratio of the color components constituting white in the output from the display device to be red (R):green (G):blue (B)=1:0.8:0.8, the signal processing unit 80 performs correction by multiplying the gradation values of green (G) and blue (B) included in the RGB signal indicated by the input signal by 0.8. Accordingly, the gradation values of the RGB signal become, for example, (R, G, B)=(255, 204, 204). That is, the white point indicates a ratio of a plurality of colors constituting white to be reproduced by combining the colors. The signal processing unit 80 corrects the gradation values of each color to cause white indicated by the input signal (for example, (R, G, B)=(255, 255, 255)) to correspond to the ratio of a plurality of colors that is determined based on the white point.

When the ratio of the color components of the external light $L_2$ is red (R):green (G):blue (B)=1:0.8:0.8, the display device can perform color reproduction similarly to color reproduction performed under illumination of only the external light $L_2$ even under illumination of light in which the ratio of the color components is red (R):green (G):blue (B)=1:1:1 (for example, only the internal light $L_1$) by correcting the input signal as described above with reference to FIG. 16. In this way, the display device can perform any color reproduction by correcting the input signal based on color reproduction of a predetermined color (for example, white). In the description with reference to FIG. 16, the ratio of the color components of the external light $L_2$ is exemplified. However, the definition of white is not limited to the ratio of the color components of the external light $L_2$, and may be freely predetermined. The definition of white in the RGB signal indicated by the input signal is not limited to (R, G, B)=(255, 255, 255), and may be changed as appropriate. The signal processing unit 80 corrects the input signal in accordance with a difference between the ratio of the color components of the input signal and the ratio (white point) of the color components constituting white as a target in the output from the display device. The signal processing unit 80 may correct the input signal using the white point with a color management mechanism (for example, the 3×3 matrix as represented by the expression (4)). The left side of the expression (4) represents the white point, the matrix (R, G, B) in the right side represents the gradation values of the input signal (RGB signal), and coefficients constituting the 3×3 matrix represent coefficients for correction. A color as a reference for correcting the gradation value may be any color other than white.

$$\begin{pmatrix} R' \\ G' \\ B' \end{pmatrix} = \begin{pmatrix} a11 & a12 & a13 \\ a21 & a22 & a23 \\ a31 & a32 & a33 \end{pmatrix} \begin{pmatrix} R \\ G \\ B \end{pmatrix} \tag{4}$$

In the present embodiment, a case is exemplified in which the RGB signal is represented as an 8-bit value. However, this is merely an example of the RGB signal, and the embodiment is not limited thereto. Specific matters such as the number of bits of the RGB signal can be changed as appropriate. For example, a value larger than the 8-bit value such as a 16-bit value may be used, or a value smaller than the 8-bit value such as a 4-bit value may be used.

The following describes the analysis processing at Step S5 and correction of the brightness in the output. FIG. 17 is a schematic diagram illustrating an example of a case of correcting the input signal using the white point and the magnification of the luminance. For example, to cause the luminance of the color to be reproduced with the RGB signal indicated by the input signal to be N times higher (for example, N=2) in the output from the display device, as illustrated in FIG. 17, the signal processing unit 80 calculates a necessary luminance value by multiplying the gradation value of the RGB signal indicated by the input signal by a correction value corresponding to the white point and the value (N) indicating the magnification of the luminance. The necessary luminance value includes information indicating the ratio of the colors (for example, red (R), green (G), and blue (B)) required for output and information indicating the luminance for each color.

In the following description with reference to FIGS. 17 to 22, a case is exemplified in which the external light intensities are (R(OL), G(OL), B(OL))=(1, 0.8, 0.8), and the ratio of the color components indicated by the white point determined in accordance with the external light intensity is red (R):green (G):blue (B)=(255:204:204). That is, the white point is set for reproducing white that is visually recognized when the display output of (R, G, B)=(255, 255, 255) is performed under the environment with only the external light $L_2$. Such a setting of the white point is merely an example. The embodiment is not limited thereto, and can be changed as appropriate. For example, the white point may be set irrespective of the external light $L_2$.

Assuming that the color components of red (R), green (G), and blue (B) indicated by the necessary luminance value are Rt, Gt, and Bt, respectively, Rt, Gt, and Bt are obtained from the following expressions (5), (6), and (7). In the expressions (5), (6), and (7), $I_1$, $I_2$, and $I_3$ represent the gradation value of the first color, the gradation value of the second color, and the gradation value of the third color, respectively, indicated by the input signal. The expressions (5), (6), and (7) are applied to the gradation values indicated by the input signal for one unit pixel 45.

$$Rt = I_1 \times N \tag{5}$$

$$Gt = I_2 \times N \tag{6}$$

$$Bt = I_3 \times N \tag{7}$$

In the present embodiment, the signal processing unit 80 determines N based on the external light intensity measured by the sensor 85. Specifically, the signal processing unit 80 defines N as a value corresponding to a ratio between the reflection luminance illustrated in FIG. 11 and optimum luminance, for example. As a specific example, when the sensor 85 measures the external light intensity the reflection luminance of which is ½ of the exemplary luminance, the signal processing unit 80 sets N to be 2. In this way, by setting N to be the reciprocal of reflection luminance/exemplary luminance, the signal processing unit 80 can correct the input signal based on the external light intensity. In the present embodiment, an upper limit value of N depends on the ratio between the external light intensity and the intensity of the internal light $L_1$ and on an upper limit of the intensity of the internal light $L_1$. Alternatively, the value (N) indicating the magnification of the luminance does not necessarily depend on the external light intensity, and may be set to be a predetermined real number larger than 0 (N>0).

For example, as illustrated in FIG. 17, it is assumed that the input signal indicates (R, G, B)=(180, 225, 80). In this case, when the external light intensities are (R(OL), G(OL), B(OL))=(1, 0.8, 0.8) and when the ratio of the color components indicated by the white point determined based on the external light intensity is red (R):green (G):blue (B)=(255:204:204), as indicated by "white point" illustrated in FIG. 17, the signal processing unit 80 multiplies the gradation value of red (R) by 1 and multiplies the gradation values of green (G) and blue (B) by 0.8 as correction values based on the white point. As indicated by "magnification (N) of luminance" illustrated in FIG. 17, the signal processing unit 80 multiplies the gradation value of each color by a value corresponding to the magnification (N) of the luminance (for example, N=2). Thus, in the example illustrated in FIG. 17, (Rt, Gt, Bt)=(360, 360, 128) is calculated as the necessary luminance value.

FIG. 18 is a schematic diagram illustrating an example of calculation of luminance required to be supplemented. Depending on the value (N) indicating the magnification of the luminance, as illustrated in the example of FIG. 17, the necessary luminance value may exceed an upper limit of the gradation value that can be reproduced with only the external light $L_2$. In this case, to perform output in accordance with the gradation value exceeding the upper limit in necessary luminance values, the signal processing unit 80 performs processing for obtaining light from the first light source 51R, the second light source MG, and the third light source 51B in accordance with the output of the gradation value exceeding the upper limit. Specifically, as illustrated in FIG. 18 for example, the signal processing unit 80 subtracts, from the necessary luminance value, the maximum luminance of the color component that can be displayed with the external light $L_2$ The signal processing unit 80 defines the luminance corresponding to the luminance of the remaining color component (luminance required to be supplemented) as a color component of luminance to be supplemented with the light from the first light source 51R, the second light source MG, and the third light source 51B. More specifically, the signal processing unit 80 calculates the luminance required to be supplemented for each of the color components of the first color, the second color, and the third color using the following expressions (8), (9), and (10). The signal processing unit 80 calculates the output of the light emitting region for obtaining the luminance of light corresponding to the luminance required to be supplemented, for each of the color components of the first color, the second color, and the third color, using the following expressions (11), (12), and (13). That is, the signal processing unit 80 calculates the intensity of the internal light $L_1$ to be emitted from each of the light emitting unit 51 in the light emitting region using the following expressions (11), (12), and (13). The intensity of the internal light $L_1$ is represented as a value equal to or larger than 0, for example, 0 indicates a state in which the light emitting region is not lit, and a predetermined maximum value (for example, 1) indicates a state in which the light emitting region is lit with the maximum output. When the intensity of the internal light $L_1$ required for supplementing the luminance deficiency for any one of color components exceeds 0, the light emitting region is required to be lit. In the expressions (8) to (13), Rf, Gf, and Bf represent values of the luminance required to be supplemented of the first color, the second color, and the third color, respectively (refer to FIG. 18). In the expressions (8) to (13), $OL_1$, $OL_2$, and $OL_3$ represent the respective intensities of the light in the first color, the second color, and the third color, respectively, included in the external light $L_2$. In the expressions (11), (12), and (13), the left sides (R(FL), G(FL), and B(FL)) represent the respective intensities of the internal light $L_1$ required for reproducing each of the color components of red (R), green (G), and blue (B), respectively. In the expressions (11), (12), and (13), FL(r), FL(g), and FL(b) represent the luminance values of red (R), green (G), and blue (B), respectively, that are supplemented when the light emitting region is lit with the maximum output. In the present embodiment, the intensity of the internal light $L_1$ has the ratio of red (R):green (G):blue (B)=1:1:1 when each of the first light source 51R, the second light source 51G, and the third light source 51B emits light with the maximum output from the light emitting region, and the luminance of the sub-pixels 48 of red (R), green (G), and blue (B) satisfies FL(r)=FL(g)=FL(b)=255. However, this is merely an example of an output characteristic of the light emitting region, and the embodiment is not limited thereto. FL(r), FL(g), and FL(b) are determined in accordance with the intensity and the like of the light output from the light emitting region.

$$Rf=Rt-OL_1 \quad (8)$$

$$Gf=Gt-OL_2 \quad (9)$$

$$Bf=Bt-OL_3 \quad (10)$$

$$R(FL)=Rf/FL(r) \quad (11)$$

$$G(FL)=Gf/FL(g) \quad (12)$$

$$B(FL)=Bf/FL(b) \quad (13)$$

For example, when the maximum value of the reflection luminance of the external light $L_2$ is (R, G, B)=(255, 204, 204) with respect to the necessary luminance value of (Rt, Gt, Bt)=(360, 360, 128) (refer to FIGS. 17 and 18), the values of (R, G, B)=(105, 156, 0) are calculated. In this calculation, if a value obtained by subtracting the maximum value of the reflection luminance of the external light $L_2$ from the necessary luminance value becomes smaller than 0, it is determined that the value is 0 (refer to FIG. 18). The gradation values of the respective colors obtained as such values represent the luminance required to be supplemented (Rf, Gf, Bf).

When the luminance required to be supplemented illustrated in FIG. 18 and the luminance values of red (R), green (G), and blue (B) (FL(r)=FL(g)=FL(b)=255) that are supplemented when the light emitting region is lit with the maximum output in the present embodiment are applied to the expressions (11) to (13), R(FL)=0.41, G(FL)=0.61, and B(FL)=0 are satisfied.

For example, it is assumed that the gradation value $T_2$ is calculated by applying the value corresponding to the magnification (N) of the luminance (for example, N=2) to the gradation value T illustrated in FIG. 8. The gradation value T can be output with only the external light $L_2$. Thus, the output of the gradation value T can be achieved with only the external light $L_2$. The gradation value $T_2$ is larger than the gradation value T. Accordingly, the output of the gradation value $T_2$ requires to be supplemented with the internal light $L_1$ in addition to the external light $L_2$. In this case, a difference between the light intensity required for outputting the gradation value $T_2$ and the external light intensity (for example, a difference between the reflection luminance $U_a$ and the reflection luminance $L_a$) is the luminance required to be supplemented.

The signal processing unit 80 causes the light emitting region to emit light having the luminance corresponding to the maximum intensity of the internal light $L_1$ in one partial region out of the calculated intensities of the internal light $L_1$ (R(FL), G(FL), B(FL)) of the sub-pixel 48. Specifically, taking the first color as an example, the signal processing unit 80 calculates R(FL) for each of sub-pixels 48R of the first color included in one partial region using the expression (11). When the number of the sub-pixels 48R of the first color included in one partial region is k, the intensities calculated in accordance with the necessary luminance value of the respective sub-pixels 48 of the first color included in one partial region can be represented as $\{R(FL)_1, \ldots, R(FL)_k\}$. The signal processing unit 80 specifies the maximum intensity of such intensities of the internal light $L_1$. The signal processing unit 80 defines the specified maximum intensity as the intensity of the internal light $L_1$ ($IL_1$) to be emitted from the first light source 51R in the light emitting region that emits light to the one partial region. Thus, an expression for obtaining the intensity of the internal light $L_1$ ($IL_1$) to be emitted from the first light source 51R is, for example, the following expression (14). For the second color and the third color, similarly to the first color, the signal processing unit 80 calculates G(FL) and B(FL) using the expressions (12) and (13), for example, and obtains the intensity of the internal light $L_1$ ($IL_2$) to be emitted from the second light source 51G and the intensity of the internal light $L_1$ ($IL_3$) to be emitted from the third light source 51B. An expression for obtaining the intensity of the internal light $L_1$ ($IL_2$) to be emitted from the second light source 51G and an expression for obtaining the intensity of the internal light $L_1$ ($IL_3$) to be emitted from the third light source 51B are, for example, the following expressions (15) and (16). In the expression (15), it is assumed that the number of the sub-pixels 48G of the second color included in one partial region is p. In the expression (16), it is assumed that the number of the sub-pixels 48B of the third color included in one partial region is q.

$$IL_1=\mathrm{MAX}\{R(FL)_1, \ldots, R(FL)_k\} \quad (14)$$

$$IL_2=\mathrm{MAX}\{G(FL)_1, \ldots, G(FL)_p\} \quad (15)$$

$$IL_3=\mathrm{MAX}\{B(FL)_1, \ldots, B(FL)_q\} \quad (16)$$

FIG. 19 is a schematic diagram illustrating an example of processing for deriving the intensity of the internal light $L_1$ for each unit of processing. In FIG. 19, the gradation value taking the maximum value for each color is masked for each unit of processing. As illustrated in FIG. 19, necessary luminance values (Rt, Gt, Bt) of a plurality of unit pixels 45 included in a partial region of the unit of processing $U_1$ are (360, 360, 128), (300, 300, 100), (200, 200, 50), (100, 100, 25), (50, 50, 0) . . . . In the partial region of the unit of processing $U_1$, the necessary luminance values (Rt, Gt, Bt)=(360, 360, 128) of one unit pixel 45 indicate the maximum values for all of the necessary luminance value (Rt) of red (R), the necessary luminance value (Gt) of green (G), and the necessary luminance value (Bt) of blue (B). Accordingly, the signal processing unit 80 employs (R(FL), G(FL), B(FL))=(0.41, 0.61, 0) as the intensities of the internal light $L_1$ ($IL_1$, $IL_2$, $IL_3$), which are calculated based on the necessary luminance values (Rt, Gt, Bt)=(360, 360, 128) of the one unit pixel 45. That is, the intensity of the internal light $L_1$ is determined based on the sub-pixel 48 having the gradation value that most requires to be supplemented with the internal light $L_1$ in one partial region irrespective of low degrees of gradation values of the other sub-pixels 48 included in the partial region.

The necessary luminance values (Rt, Gt, Bt) of a plurality of unit pixels included in a partial region of the unit of processing $U_2$ are (360, 250, 100), (300, 360, 100), (100, 100, 128), (100, 100, 25), (50, 50, 0) . . . . In the partial region of the unit of processing $U_2$, the unit pixel 45 having the necessary luminance values (360, 250, 100) exhibits the maximum value of the necessary luminance value of red (R) (Rt=360). The unit pixel 45 having the necessary luminance values (300, 360, 100) exhibits the maximum value of the necessary luminance value of green (G) (Gt=360). The unit pixel 45 having the necessary luminance values (100, 100, 128) exhibits the maximum value of the necessary luminance value of blue (B) (Bt=128). In this case, in calculating the intensity of the internal light $L_1$, the signal processing unit 80 employs the maximum value of the necessary luminance value of each color exhibited by the necessary luminance values of each of the unit pixels 45. In this case, R(FL) is 0.41 in the unit pixel 45 of (Rt=360). G(FL) is 0.61 in the unit pixel 45 of (Gt=360). B(FL) is 0 in the unit pixel 45 of (Bt=128). Accordingly, the intensities of the internal light $L_1$ of the unit of processing $U_2$ are ($IL_1$, $IL_2$, $IL_3$)=(0.41, 0.61, 0). In this way, the necessary luminance value for deriving the intensities of the internal light $L_1$ are determined for each unit of processing based on the necessary luminance values of a plurality of unit pixels 45 included in one unit of processing. The signal processing unit 80 derives the intensity of the internal light $L_1$ for each unit of processing. The signal processing unit 80 calculates the intensity of the internal light $L_1$ based on the derived intensity of the internal light $L_1$ and the external light intensity.

In the present embodiment, the intensities of the light from the first light source 51R, the second light source 51G, and the third light source 51B in the light emitting region are controlled for each unit of processing. Thus, the intensities of the light from the first light source 51R, the second light source 51G, and the third light source 51B required for each unit of processing needs to be the luminance corresponding to the output of the sub-pixel 48 that performs output with the highest luminance among a plurality of sub-pixels 48 included in the partial region in each unit of processing. The signal processing unit 80 performs analysis processing for each of the unit pixels 45 included in one partial region. In the analysis processing, the signal processing unit 80 calculates the necessary luminance value and determines the intensities of the internal light $L_1$ to be emitted from each of the first light source 51R, the second light source 51G, and the third light source 51B. In this way, the analysis processing performed by the signal processing unit 80 includes processing of calculating the necessary luminance value for obtaining the luminance N (N>0) times the luminance value indicated by the input signal in the sub-pixel 48 that performs output with the highest gradation value among the sub-pixels 48 included in a predetermined image display region (for example, one partial region). In the analysis processing, in the process of calculating the luminance required to be supplemented, the intensities of the internal light $L_1$ ($IL_1$, $IL_2$, $IL_3$) to be emitted from the first light source 51R, the second light source 51G, and the third light source 51B is determined based on a comparison result between the intensity of the external light $L_2$ and the necessary luminance value (for example, a result of subtracting an upper limit of the gradation value that can be reproduced with only the external light $L_2$ from the necessary luminance value). The signal processing unit 80 outputs, to the light-source-unit control circuit 60, a signal (light emitting region control signal) for causing the first light source 51R, the second light source 51G, and the third light source 51B in the light emitting region to emit light with the determined intensities of the internal light $L_1$ ($IL_1$, $IL_2$, $IL_3$).

In the present embodiment, the signal processing unit 80 obtains R(FL), G(FL), and B(FL) for each unit pixel 45, and thereafter, defines the maximum R(FL), the maximum G(FL), and the maximum B(FL) for each unit of processing as the intensities of the internal light $L_1$ ($IL_1$, $IL_2$, $IL_3$). Alternatively, the signal processing unit 80 may specify the maximum gradation value for each of the colors in the unit pixel 45 for each unit of processing, calculate R(FL), G(FL), and B(FL) for outputting the specified maximum gradation value of each color, and define R(FL), G(FL), and B(FL) as the intensities of the internal light $L_1$ ($IL_1$, $IL_2$, $IL_3$). In this case, the signal processing unit 80 calculates (R(FL), G(FL), B(FL))=(105, 156, 0) as ($IL_1$, $IL_2$, $IL_3$) based on the necessary luminance value (Rt, Gt, Bt)=(360, 360, 128) for both of the unit of processing $U_1$ and the unit of processing $U_2$.

FIG. 20 is a schematic diagram illustrating an example of an arithmetic operation for determining the output signal. FIG. 20 illustrates an example of a case in which the luminance required to be supplemented that is calculated from one necessary luminance value illustrated in FIG. 18 exhibits the maximum value in one partial region for all of the first color, the second color, and the third color. The signal processing unit 80 corrects the necessary luminance value based on the premise that the luminance is increased by the light from the light emitting region that is lit in accordance with the maximum intensity of the internal light $L_1$. Specifically, the signal processing unit 80 corrects the necessary luminance value using the following expressions (17), (18), and (19), and determines the gradation values ($O_1$, $O_2$, $O_3$) to be indicated by the output signals for the sub-pixels 48 included in the unit pixel 45. In the expressions (17), (18), and (19), $OL_1$, $OL_2$, and $OL_3$ represent the intensities of the light in the first color, the second color, and the third color, respectively, included in the external light $L_2$. In the expressions (17), (18), and (19), R(IL), G(IL), and B(IL) each represent the intensity that can be secured with the light from the light emitting region (internal light $L_1$).

$$O_1=Rt/(OL_1+IL_1) \quad (17)$$

$$O_2=Gt/(OL_2+IL_2) \quad (18)$$

$$O_3=Bt/(OL_3+IL_3) \quad (19)$$

As represented by the expressions (17), (18), and (19), and the expressions (5), (6), and (7), assuming that the intensity of the light in the first color included in the external light $L_2$ is $OL_1$, the intensity of the light in the second color included in the external light $L_2$ is $OL_2$, the intensity of the light in the third color included in the external light $L_2$ is $OL_3$, the intensity of the light to be emitted from the first light source 51R is $IL_1$, the intensity of the light to be emitted from the second light source 51G is $IL_2$, the intensity of the light to be emitted from the third light source 51B is $IL_3$, the gradation value of the first color indicated by the input signal is $I_1$, the gradation value of the second color indicated by the input signal is $I_2$, the gradation value of the third color indicated by the input signal is $I_3$, an output gradation value for the sub-pixel of the first color is $O_1$, the output gradation value for the sub-pixel of the second color is $O_2$, and the output gradation value for the sub-pixel of the third color is $O_3$, the signal processing unit 80 of the display device calculates the output gradation value for each of the sub-pixels 48 based on the expressions (1) to (3) described above. If $IL_m>0$ (m is 1, 2, or 3) is satisfied, the signal processing unit 80 according to the present embodiment calculates the necessary luminance value under a condition that the output gradation value of the sub-pixel that performs an output with the highest gradation value among the sub-pixels of the m-th color included in the predetermined image display region (for example, one partial region) is set to be the gradation value that maximizes the light transmittance. As a specific example, it is assumed that the luminance required to be supplemented (Gf) of the second color out of the luminance required to be supplemented exemplified in FIG. 20 is the maximum luminance required to be supplemented out of the luminance required to be supplemented of the second color in one partial region. In this case, the sub-pixel 48G of green (G) included in the unit pixel 45 the light intensity of which most requires to be supplemented with the second light source 51G is output with the maximum gradation value (255). In this way, by controlling the gradation value, supplement of the light from the illumination unit 20 can be minimized, and intended luminance can be secured at the same time.

In this way, the signal processing unit 80 calculates the gradation value to be indicated by the output signal of the sub-pixel 48 using the expressions (17) to (19) for each of the unit pixels 45 included in the partial region to determine the gradation value of each of the unit pixels 45 included in the partial region in one unit of processing as in the process at Step S8.

The signal processing unit 80 performs the same processing as that described above for each unit of processing. Due to this, the signal processing unit 80 determines the intensity of the internal light $L_1$ of each of all the light emitting regions included in the light source unit 50, and determines the gradation value to be indicated by the output signal of each of the sub-pixels 48 included in each of all the partial regions included in the display unit 10. In this way, the signal processing unit 80 calculates the necessary luminance value of one light emitting region corresponding to the one partial region serving as the predetermined image display region, determines the intensities of the light from the first light source 51R, the second light source 51G, and the third light source 51B to be emitted from the one light emitting region, and calculates the output gradation value of each of the sub-pixels 48 included in the one partial region.

FIG. 21 is a diagram illustrating an example of controlling the internal light $L_1$ and calculating the gradation value for each unit of processing. The external light $L_2$ is common to all units of processing. FIG. 21 illustrates a case in which the external light intensities are (R(OL), G(OL), B(OL))=(1.0, 0.8, 0.8). In the units of processing $U_1$ and $U_2$ illustrated in FIG. 21, the necessary luminance values (Rt, Gt, Bt)=(360, 360, 128) are obtained based on the input signals for the unit pixels 45 included in the unit of processing. Thus, in the units of processing $U_1$ and $U_2$, ($IL_1$, $IL_2$, $IL_3$)=(0.41, 0.61, 0) is satisfied as described above with reference to FIGS. 17 to 20. In a unit of processing $U_3$ illustrated in FIG. 21, the necessary luminance values (Rt, Gt, Bt)=(360, 128, 128) are obtained based on the input signals for the unit pixels 45 included in the unit of processing. Thus, in the unit of processing $U_3$, ($IL_1$, $IL_2$, $IL_3$)=(0.41, 0, 0) is satisfied. In a unit of processing $U_4$ illustrated in FIG. 21, the necessary luminance values (Rt, Gt, Bt)=(200, 128, 128) are obtained based on the input signals for the unit pixels 45 included in the unit of processing. Thus, in the unit of processing $U_4$, ($IL_1$, $IL_2$, $IL_3$)=(0, 0, 0) is satisfied. In this way, according to the present embodiment, the light emitting unit 51 arranged in each of the units of processing can be independently controlled with the intensity of the internal light $L_1$ required for each unit of processing. FIG. 21 illustrates the necessary luminance value and the intensity of the internal light $L_1$ for the four units or processing $U_1$, $U_2$, $U_3$, and $U_4$. The signal processing unit 80 also performs processing independently for other units of processing using the same mechanism.

Figures 22, 23:
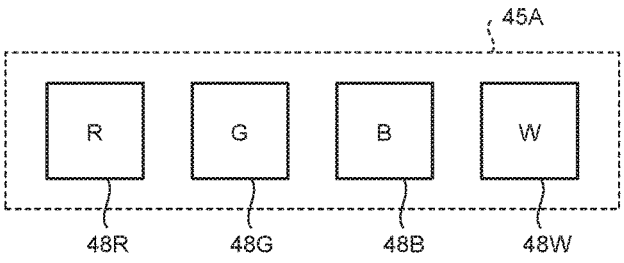
FIG. 22 is a diagram illustrating an example of calculating gradation values of a plurality of unit pixels included in one unit of processing.
FIG. 23 is a diagram illustrating an example of a unit of color reproduction with a plurality of pixels functioning as sub-pixels in a modification.

FIG. 22 is a diagram illustrating an example of calculating the gradation values of a plurality of unit pixels included in one unit of processing. FIG. 22 illustrates a case in which the external light intensities are (R(OL), G(OL), B(OL))=(1, 0.8, 0.8). The necessary luminance values (Rt, Gt, Bt) of the unit pixels 45 included in the unit of processing $U_1$ are (360, 360, 128), (300, 300, 100), (200, 200, 50), (100, 100, 25), (50, 50, 0) . . . . The signal processing unit 80 calculates, with respect to the necessary luminance values, the gradation values according to the intensity of the entering light L based on the external light intensities (R(OL), G(OL), B(OL))=(1, 0.8, 0.8) and the intensities of the internal light $L_1$ ($IL_1$, $IL_2$, $IL_3$)=(0.41, 0.61, 0) in the unit of processing $U_1$, based on the expressions (17), (18), and (19). Accordingly, as illustrated in FIG. 22, the gradation values indicated by the output signals for the unit pixels 45 become ($O_1$, $O_2$, $O_3$)=(255, 255, 160), (213, 213, 120), (142, 142, 60), (71, 71, 30), (35, 35, 0) . . . . FIG. 22 illustrates a case of the unit of processing $U_1$, and the signal processing unit 80 also performs processing independently for other units of processing using the same mechanism. The values of ($O_1$, $O_2$, $O_3$) exemplified in FIG. 22 are rounded off the first decimal place. However, this is merely an example of a method for processing a fraction, and the embodiment is not limited thereto. For example, the fraction may be rounded down or rounded up, and the embodiment can be modified as appropriate.

Deviation between the frame of the output from the light emitting region (light emission) and the frame of an image output from the display unit 10 is allowed so long as the deviation is such a short time that cannot be visually recognized with eyes of a human. For example, when the display device 1 performs an output of an image with 60 frames per second (fps), even if the light emission timing of the light emitting region of the light source unit 50 according to the intensity of the internal light $L_1$ calculated based on the input signal corresponding to the image is delayed by 1 frame with respect to the output timing of the image from the display unit 10, the delay is allowed because it cannot be visually recognized with eyes of a human. Specific numerical values such as fps and the number of frames are merely an example, and the embodiment is not limited thereto. The degree of frame deviation that is allowed between the output timing of the image and the light emission timing can be changed as appropriate depending on the numerical value of fps.

The signal processing unit 80 outputs a signal indicating the determined gradation value to the sub-pixel 48 as the output signal. The signal processing unit 80 also outputs, to the light emitting region, a command for causing the light emitting region to emit light with the light emission intensity corresponding to the determined intensity of the internal light $L_1$ of each of the light emitting regions. The display unit 10 operates each sub-pixel 48 such that the light transmittance corresponds to the gradation value indicated by the output signal. The illumination unit 20 causes each light emitting region to be lit with the light emission intensity in accordance with the command.

In the present embodiment, any color space can be employed by changing the definition of white indicated by the white point, that is, the ratio of a plurality of colors constituting white. As a specific example, a measuring unit (for example, the sensor 85) measures the intensity of the color components of each of a plurality colors included in the external light $L_2$, and the signal processing unit 80 employs the ratio of the measured intensity of the color components of the first color, the second color, and the third color as the definition of the white point, that is, the ratio of the first color, the second color, and the third color constituting white. Thus, the color to be output as white can be caused to be white that is visually recognized under an irradiation condition of the external light $L_2$. In other words, by employing such a white point, a color space of the display output from the display device can be caused to be a color space under the irradiation condition of the external light $L_2$ irrespective of the ratio of the colors constituting light emitted to the display panel 30.

A definition of the color space with the white point is not limited to the ratio of the intensity of the external light $L_2$ for each of a plurality of colors. For example, the signal processing unit 80 may equalize all values of the ratio of the first color, the second color, and the third color constituting white. That is, the signal processing unit 80 may cause the ratio of a plurality of colors indicated by the definition of the white point to be 1:1:1. The internal light $L_1$ according to the present embodiment falls under the above condition because the ratio of the color components of red (R), green (G), and blue (B) is 1:1:1. By setting the ratio of a plurality of colors indicated by the definition of the white point in the present embodiment to be 1:1:1, the color space under a light irradiation condition in which there is no deviation in the color components of the first color, the second color, and the third color can be obtained irrespective of the ratio of the colors constituting the light emitted to the display panel 30.

In the present embodiment, there may be a case in which the internal light $L_1$ is not used, for example, a case in which the external light intensity is sufficient for the display output. When the display output is intentionally set to be darker, for example, a possibility that the external light intensity is sufficient for the display output is further increased. There may be a case in which the external light intensity is 0, for example, a case in which the surroundings of the electronic apparatus 1 including the display device are completely dark.

As described above, according to the present embodiment, the display output can be performed with the brightness according to the external light intensity. By calculating the necessary luminance value of one light emitting region corresponding to one partial region serving as the predetermined image display region, determining the intensities of light from each of the first light source 51R, the second light source 51G, and the third light source 51B to be emitted from the one light emitting region, and calculating the output gradation values of the sub-pixel of the first color, the sub-pixel of the second color, and the sub-pixel of the third color included in each of a plurality of pixels included in the one partial region, control can be performed to cause each light emitting region to emit light with the intensity of the internal light $L_1$ required for each partial region. Thus, even when outputs from some of the partial regions are bright, the light emission quantity of the light emitting region corresponding to a partial region for which a supplement with the internal light $L_1$ is not required or light having relatively low intensity is required can be reduced, which can further reduce power consumption.

Color reproduction in any color space can be performed by correcting the gradation value of the first color, the gradation value of the second color, and the gradation value of the third color indicated by the input signal using the ratio of the first color, the second color, and the third color constituting white that is reproduced by combining the first color, the second color, and the third color.

By setting the ratio of the measured intensities of the color components of a plurality of colors to be the ratio of the first color, the second color, and the third color constituting white, color reproduction can be performed under an illumination condition with only the external light $L_2$ irrespective of the ratio of the colors constituting the light emitted to the display panel 30.

By equalizing all values of the ratio of the first color, the second color, and the third color constituting white, color reproduction can be performed in a color space in which all values of a ratio of a plurality of colors constituting white are equal to each other even when values of the ratio of the colors constituting the light emitted to the display panel 30 are not equal to each other.

Each of the sub-pixels 48 is a sub-pixel for outputting one of red (R), green (G), and blue (B), and the display unit 10 performs color reproduction in accordance with the RGB signal by combining outputs of the sub-pixel 48R of red (R), the sub-pixel 48G of green (G), and the sub-pixel 48B of blue (B), so that color conversion processing and the like in processing for obtaining the output signal from the input signal can be minimized.

If $IL_m>0$ is satisfied, when the necessary luminance value is calculated under a condition that the output gradation value of the sub-pixel that performs an output with the highest gradation value among the sub-pixels of the m-th color included in the predetermined image display region is set to be the gradation value for maximizing the light transmittance, the supplement with the internal light $L_1$ can be minimized and intended luminance can be secured at the same time.

Modification

Next, the following describes a modification of the present invention. FIG. 23 is a diagram illustrating an example of a unit of color reproduction with a plurality of sub-pixels 48 functioning as the sub-pixels 48 in the modification. In the modification, each of the sub-pixels 48 is a sub-pixel that outputs one of the first color, the second color, the third color, and the fourth color, and the display panel 30 performs color reproduction by combining outputs of the sub-pixels 48 of the first color, the second color, the third color, and the fourth color. Specifically, in the modification, each of the sub-pixels 48 is a sub-pixel that outputs one of red (R), green (G), blue (B), and white (W), and the display panel 30 performs color reproduction in accordance with the input signal by combining outputs of the sub-pixel 48R of red (R), the sub-pixel 48G of green (G), the sub-pixel 48B of blue (B), and the sub-pixel 48W of white (W). In the modification, provided are a plurality of unit pixels 45A each including one sub-pixel 48R of red (R), one sub-pixel 48G of green (G), one sub-pixel 48B of blue (B), and one sub-pixel 48W of white (W) in place of the unit pixels 45 in the above embodiment. As described above, in the modification, the first color, the second color, the third color, and the fourth color are red (R), green (G), blue (B), and white (W), respectively.

FIG. 24 is a schematic diagram illustrating an example of calculating the luminance required to be supplemented in the modification. In the modification, after the necessary luminance value (refer to FIG. 17) is calculated in the analysis processing, the color components corresponding to the ratio of the color components constituting white defined with the white point (refer to FIG. 16) are extracted as the luminance (gradation value) of the sub-pixel 48W of white (W). Specifically, the color components constituting white defined with the white point (for example, (R, G, B)=(255, 204, 204) illustrated in FIG. 16) are defined as the maximum luminance of white (W=255). The signal processing unit 80 extracts a white component that can be extracted from the necessary luminance value based on the ratio of the color components constituting white defined with the white point. For example, in the case of (R, G, B)=(255, 204, 204) illustrated in FIG. 16, the ratio of the color components constituting white is red (R):green (G):blue (B)=1:0.8:0.8. As illustrated in FIG. 24, when the color components of the necessary luminance values are (R, G, B)=(360, 360, 128), the color components that can be extracted as the white component based on red (R):green (G):blue (B)=1:0.8:0.8 are (R, G, B)=(160, 128, 128), which corresponds to W=160. In this case, the signal processing unit 80 replaces (R, G, B)=(160, 128, 128) with W=160 to be set as the gradation value of the sub-pixel 48W of white (W), and subtracts the gradation value extracted as the component constituting white from the gradation values of red (R), green (G), and blue (B). As a result, the gradation values of the unit pixel 45A having the color components of the necessary luminance values of (R, G, B)=(360, 360, 128) as the RGB signal are converted into an RGBW signal of (R, G, B, W)=(200, 232, 0, 160). Due to this, when the maximum luminance of the color component that can be displayed with the external light $L_2$ is (R, G, B)=(255, 208, 208), the color component that requires light from the illumination unit 20 is only green (G) (Gf=24). In this way, the signal processing unit 80 according to the modification replaces the necessary luminance value calculated based on the RGB signal of the input signal with the RGBW signal in the analysis processing.

The signal processing unit 80 subtracts the maximum luminance of the color component that can be output with the external light $L_2$ from the necessary luminance value replaced with the RGBW signal, and defines luminance corresponding to the luminance of the remaining color component (luminance required to be supplemented) as the color component of the luminance to be supplemented with the internal light $L_1$. Subsequent processing in the analysis processing according to the modification is the same as that in the above embodiment. More specifically, the signal processing unit 80 calculates the intensity of the internal light $L_1$ in the light emitting region for supplementing the luminance deficiency for the color components of the first color, the second color, and the third color using the expressions (8) to (13) described above. The signal processing unit 80 causes light corresponding to the maximum intensity of the intensities of the internal light $L_1$ calculated for each of the first color, the second color, and the third color to be emitted from the first light source 51R, the second light source 51G, and the third light source 51B in the light emitting region. The maximum intensity of the internal light $L_1$ required for each of the first light source 51R, the second light source 51G, and the third light source 51B is obtained, for example, using the expressions (14), (15), and (16) described above.

In the processing at Step S8, the signal processing unit 80 extracts, as the gradation values of the sub-pixel 48W of white (W) of the unit pixel 45A, the color components corresponding to the ratio of the color components constituting white defined with the white point from among the color components of the unit pixel 45A indicated by the gradation values of red (R), green (G), and blue (B) calculated using the expressions (17), (18), and (19), and subtracts the value corresponding to an amount of the components extracted as the gradation values of the sub-pixel 48W of white (W) from the gradation values of red (R), green (G), and blue (B) to perform expansion processing of causing the output signal to be the RGBW signal. Details about the processing of replacing the color components of red (R), green (G), and blue (B) with white are the same as those of the processing of replacing with the RGBW signal in the analysis processing described above with reference to FIG. 24. In this way, in the modification, the signal processing unit 80 defines the color component that can be output from the sub-pixel of the fourth color as the gradation value of the sub-pixel of the fourth color, the color component being included in the color components included in the color to be reproduced by combining the gradation values of the first color, the second color, and the third color indicated by the input signal.

In the expansion processing, exception processing is performed in some cases. The exception processing may be performed when the sub-pixels 48 corresponding to the respective light intensities of the first light source 51R, the second light source 51G, and the third light source 51B are not included in the same unit pixel 45A. The exception processing is not required in a case where the sub-pixels 48 corresponding to the respective "maximum intensities of the internal light $L_1$" in the first color, the second color, and the third color obtained using the expressions (14), (15), and (16) are included in the same unit pixel 45A, that is, in a case where the sub-pixel 48 that requires the light intensity ($IL_1$) of the first light source 51R, the sub-pixel 48 that requires the light intensity ($IL_2$) of the second light source 51G, and the sub-pixel 48 that requires the light intensity ($IL_3$) of the third light source 51B are included in the same unit pixel 45A. However, the exception processing may be required in other cases, so that the signal processing unit 80 according to the present embodiment performs exception processing.

Figure 25:
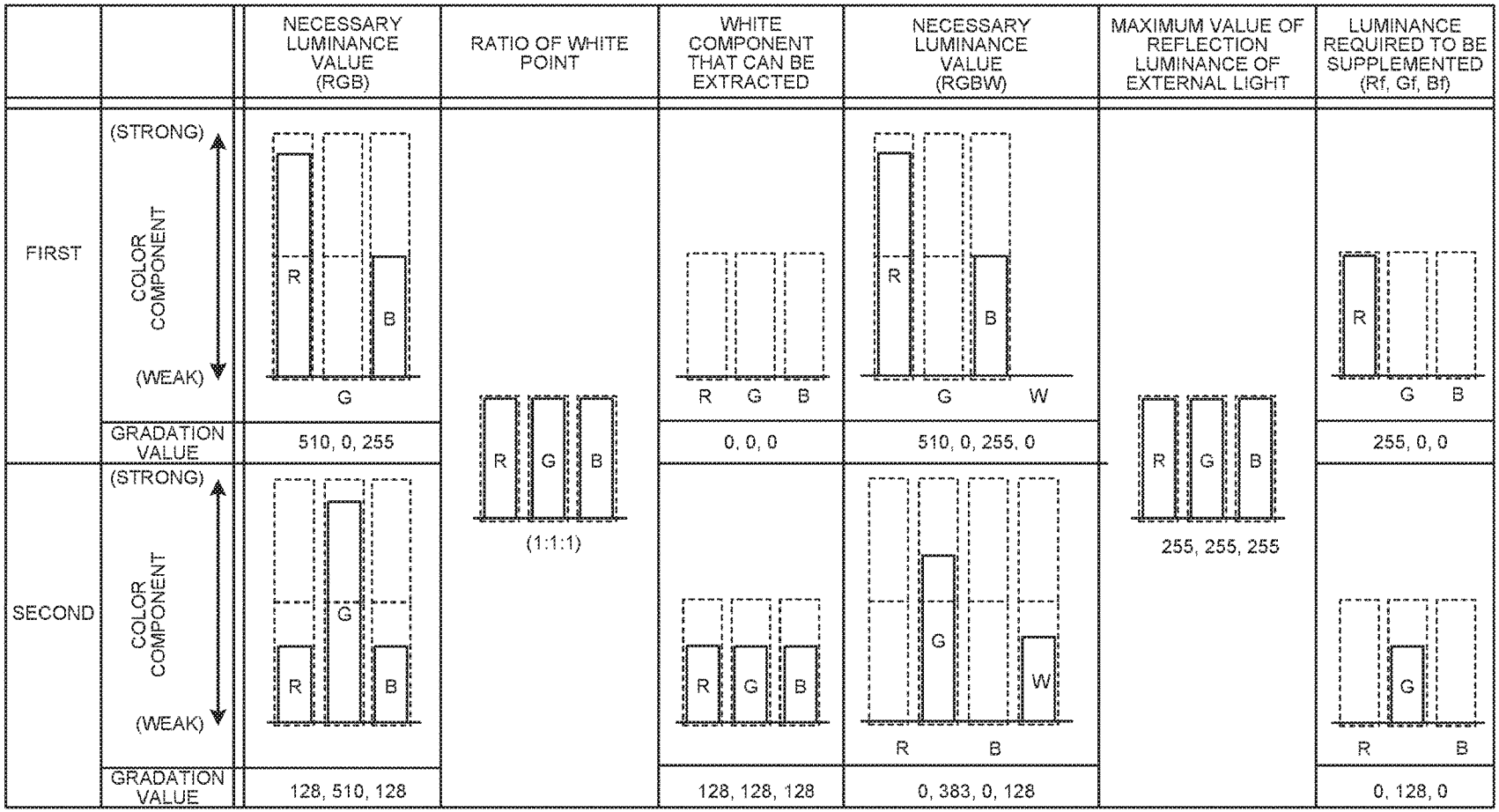
FIG. 25 is a schematic diagram illustrating an example of a case in which exception processing is required.

FIGS. 25 and 26 are schematic diagrams illustrating an example of a case in which the exception processing is required. FIGS. 25 and 26 illustrate an example of a case in which the unit pixel 45A including the sub-pixel 48 that requires the light intensity ($IL_1$) of the first light source 51R is different from the unit pixel 45A including the sub-pixel 48 that requires the light intensity ($IL_2$) of the second light source 51G. In the example of FIG. 25, the value of the intensity ($IL_1$) of light to be emitted from the first light source 51R based on the input signal to one (first) unit pixel 45A (the pixel illustrated in an upper part of FIG. 25) is 1. The value of the intensity ($IL_2$) of light to be emitted from the second light source 51G based on the input signal to the other (second) unit pixel 45A (the pixel illustrated in a lower part of FIG. 25) is 0.5. When the influence of a pixel other than these unit pixels 45A is neglected, the value of the intensity ($IL_3$) of light to be emitted from the third light source 51B is 0.

When the user tries to determine the output gradation value of the second unit pixel 45A based on the two unit pixels 45A illustrated in FIG. 25, a gain for lowering the gradation value of the sub-pixel 48R of the first color is applied in accordance with the intensity ($IL_1$) of light to be emitted from the first light source 51R, as illustrated in FIG. 26. In the case of FIG. 26, the lowered gradation value of the first color becomes a bottleneck, and the color components that can be replaced with white are reduced after the gradation value is lowered. This means that the color components to be replaced with white are reduced for the second color. Thus, the value ($IL_2$=0.5) of the intensity of light to be emitted from the second light source 51G determined based on the premise that the color components are replaced with white cannot completely cover the gradation value of the sub-pixel 48G of the second color included in the second unit pixel 45A. That is, in the second unit pixel 45A, unless the sub-pixel 48G of the second color exhibits the luminance (for example, 276) corresponding to the gradation value larger than the maximum value (for example, 255) of the gradation values of the sub-pixel 48, a state in which the luminance corresponding to the input signal cannot be exhibited (overflow) is caused in the display output.

FIGS. 27 and 28 are diagrams illustrating an example of a case in which FIGS. 25 and 26 are expressed numerically. In FIG. 27, described are "RGB pixel reflection amount" based on the light transmittance of the sub-pixel 48W of white, and "front light intensity (RGB)" indicating the light intensity of each of the first light source 51R, the second light source 51G, and the third light source 51B corresponding to the luminance required to be supplemented in FIG. 25. In "RGB pixel reflection amount" illustrated in FIG. 27, the reflection amount of the sub-pixel 48G of the second color in the second unit pixel 45A is "383" because the sub-pixel 48W of white has the light transmittance corresponding to the gradation value of "128" and the light in the second color is reflected by the sub-pixel 48W of white. As illustrated in FIG. 28, the output gradation value of the sub-pixel 48G of the second color included in the second unit pixel 45A is the luminance (for example, 276) corresponding to the gradation value larger than the maximum value (for example, 255) of the gradation value of the sub-pixel 48.

In this way, when a specific condition is satisfied in the modification, the gradation value that can be converted into white is insufficient and the luminance of some colors is insufficient due to the gain corresponding to the intensity of the internal light $L_1$ in calculating the output gradation value. The case in which a specific condition is satisfied means a case in which the input signal for the unit pixel 45A including the sub-pixel 48 that requires the intensity of the internal light $L_1$ in some of the first color, the second color, and the third color or relatively high intensity of the internal light $L_1$ close to the above intensity of the internal light $L_1$ indicates the gradation value larger than 0 for the other colors or the other color of the first color, the second color, and the third color, and in which the light source corresponding to the other colors or the other color emits light having intensity larger than 0. In this case, overflow may be caused due to the luminance deficiency in some colors corresponding to the intensity of the internal light $L_1$. To suppress the overflow, the intensity of the internal light $L_1$ for the color with deficiency of light intensity needs to be changed (corrected or updated). Thus, when the exception processing is required, the signal processing unit 80 performs processing for correcting the intensity of the internal light $L_1$ for the color with deficiency of light intensity.

The following describes an example of specific processing content of the exception processing. The signal processing unit 80 compares the intensity of light in the first color, the intensity of light in the second color, and the intensity of light in the third color with each other, the light being emitted to the display unit 10. The signal processing unit 80 specifies a maximum intensity value (FLMax), an intermediate intensity value (FLMid), and a minimum intensity value (FLMin). Specifically, the signal processing unit 80 compares values with each other, the values obtained by adding the intensities ($OL_1$, $OL_2$, $OL_3$) of light in the first color, the second color, and the third color included in the external light $L_2$ to the light intensity ($IL_1$) of the first light source 51R, the light intensity ($IL_2$) of the second light source 51G, and the light intensity ($IL_3$) of the third light source 51B obtained before the exception processing, respectively. For example, in the example illustrated in FIGS. 25 to 28, ($IL_1$, $IL_2$, $IL_3$)=(1, 0.5, 0) is satisfied. Assuming that the intensities ($OL_1$, $OL_2$, $OL_3$) of light in the first color, the second color, and the third color included in the external light $L_2$ are all 1, ($IL_1$+$OL_1$, $IL_2$+$OL_2$, $IL_3$+$OL_3$)=(2, 1.5, 1) is satisfied. If this assumption is true, the maximum intensity value, the intermediate intensity value, the minimum intensity value, and the like are specified as follows: FLMax=2, FLMid=1.5, and FLMin=1.

The signal processing unit 80 calculates correction values ($AD_2$, $AD_3$) for correcting the intermediate intensity value and the minimum intensity value using the following expressions (21) and (22), and adds the correction values to the intensities of light from the light sources of the colors corresponding to the intermediate intensity value and the minimum intensity value as represented by the expressions (24) and (25). Specifically, the signal processing unit 80 does not correct the intensity of light from the light source of the color corresponding to the maximum intensity value as represented by the expressions (20) and (23). The signal processing unit 80 does not necessarily perform an arithmetic operation using the expressions (20) and (23). The signal processing unit 80 performs such correction that the intensities of light from the light sources of the colors corresponding to the intermediate intensity value and the minimum intensity value may be further increased as represented by the expressions (21) and (22). When a result of the arithmetic operation of the expressions (21) and (22) is an infinite decimal, the signal processing unit 80 may perform fraction processing of rounding off (or rounding up or rounding down) to a certain decimal place (for example, to the third decimal place), for example.

$$AD_1=0 \tag{20}$$

$$AD_2=FL\text{Min}\times\{(FL\text{Max}-FL\text{Mid})/(FL\text{Max}+FL\text{Min})\} \tag{21}$$

$$AD_3=FL\text{Min}\times\{(FL\text{Max}-FL\text{Min})/(FL\text{Max}+FL\text{Min})\} \tag{22}$$

$$FL\text{Max}=FL\text{Max}+AD_1 \tag{23}$$

$$FL\text{Mid}=FL\text{Mid}+AD_2 \tag{24}$$

$$FL\text{Min}=FL\text{Min}+AD_3 \tag{25}$$

In the example illustrated in FIGS. 25 to 28, FLMax=2, FLMid=1.5, and FLMin=1. Accordingly, the correction value $AD_2$ for FLMid is represented by the following expression (26) based on the above expression (21). The correction value $AD_3$ for FLMin is represented by the following expression (27) based on the above expression (22).

$$AD_2=1\times\{(2-1.5)/(2+1)\}=0.167 \tag{26}$$

$$AD_2=1\times\{(2-1)/(2+1)\}=0.333 \tag{27}$$

By correcting FLMid=1.5 and FLMin=1 as represented by the above expressions (24) and (25) using the correction values $AD_2$ and $AD_3$ calculated based on the expressions (26) and (27), the values of FLMid and FLMin are updated as represented by the following expressions (28) and (29).

$$FL\text{Mid}=1.5+0.167=1.667 \tag{28}$$

$$FL\text{Min}=1+0.333=1.333 \tag{29}$$

In the example illustrated in FIGS. 25 to 28, FLMid=$IL_2$+$OL_2$ and FLMin=$IL_3$+$OL_3$ are satisfied. In this case, $OL_2$ and $OL_3$ are the intensities of the external light $L_2$, and are not targets of correction. Thus, $IL_2$ and $IL_3$ as the intensities of the internal light $L_1$ are corrected based on the above expressions (28) and (29). Specifically, $IL_2$ and $IL_3$ are obtained as represented by the following expressions (30) and (31).

$$IL_2=FL\text{Mid}-OL_2=1.667-1=0.667 \tag{30}$$

$$IL_3=FL\text{Min}-OL_3=1.333-1=0.333 \tag{31}$$

FIG. 29 is a diagram illustrating an example of the output gradation value in a case of receiving emitted light having the light intensity corrected through the exception processing. FIG. 29 illustrates an example of a case of performing the exception processing using the above expressions (20) to (25) when the output gradation values before the exception processing are calculated as in FIG. 28. When ($IL_1$, $IL_2$, $IL_3$)=(1, 0.5, 0) is satisfied, ($IL_1$, $IL_2$, $IL_3$)=(1, 0.667, 0.333) is obtained through the above expressions (26) to (31) derived based on the above expressions (20) to (25). The output gradation value (276) of the sub-pixel 48G of the second color included in the second unit pixel 45A cannot be exhibited with the intensity $IL_2$ of 0.5 before the exception processing, so that overflow occurs. By contrast, when the exception processing is performed, the intensity $IL_2$ is corrected to be 0.667, and thereby the output gradation value is reduced to a value (242) not exceeding the maximum value of the gradation value as illustrated in FIG. 29. In this way, according to the modification, overflow can be suppressed by performing the exception processing.

The specific processing content of the exception processing is not limited to the processing content described above. The following describes other specific processing content of the exception processing. First, the signal processing unit 80 specifies the maximum intensity value (FLMax), the intermediate intensity value (FLMid), and the minimum intensity value (FLMin) using the same mechanism as that of the exception processing described above. For example, in the example illustrated in FIGS. 25 to 28, ($IL_1$, $IL_2$, $IL_3$)=(1, 0.5, 0) is satisfied, so that, assuming that the intensities ($OL_1$, $OL_2$, $OL_3$) of the light in the first color, the second color, and the third color included in the external light $L_2$ are all 1, ($IL_1$+$OL_1$, $IL_2$+$OL_2$, $IL_3$+$OL_3$)=(2, 1.5, 1) is satisfied. Accordingly, FLMax=2, FLMid=1.5, and FLMin=1 are obtained.

Next, the signal processing unit 80 performs processing of selecting the gradation values of the unit pixel 45A determining the intensities of the internal light $L_1$ ($IL_1$, $IL_2$, $IL_3$) within an area (selection processing). The unit pixel 45A in which the gradation value of at least one of the first color, the second color, and the third color remains to be higher after the white component is extracted serves as the unit pixel 45A determining the intensities of the internal light $L_1$ ($IL_1$, $IL_2$, $IL_3$). There are three colors in total, that is, the first color, the second color, and the third color, so that the signal processing unit 80 selects three gradation values of the unit pixel 45A at the maximum.

The gradation values of the unit pixel 45A determining the intensity of the internal light $L_1$ ($IL_1$) in the first color are assumed to be (R, G, B)={R(x), G(x), B(x)}. As represented by the following expression (32), the signal processing unit 80 calculates the gradation values {R(x), G(xa), B(xa)} in consideration of the intensities of the internal light $L_1$ ($IL_2$, $IL_3$) and the intensities of the external light $L_2$ ($OL_2$, $OL_3$) in the other colors.

$$\{R(x),G(xa),B(xa)\}=\{R(x),G(x),B(x)\}/\{1,IL_2+OL_2,IL_3+OL_3\} \tag{32}$$

The gradation values {R(x), G(xa), B(xa)} calculated through the expression (32) take account of a possibility that a gain is applied to the gradation values of the unit pixel 45A determining the intensity of the internal light $L_1$ ($IL_1$) in the first color based on the intensities of the internal light $L_1$ ($IL_2$, $IL_3$) in colors other than the first color (the second color and the third color), and the gradation values of the other colors are reduced.

The expression (32) suggests that, when the gradation values of the colors other than the first color (the second color and the third color) are reduced, the gradation values that can be extracted as the white component are reduced. When the gradation values that can be extracted as the white component are reduced, the gradation values of the first color remaining after the extraction are increased, and the intensity of the internal light $L_1$ may be insufficient with the intensity of the internal light $L_1$ ($IL_1$) in the first color before the exception processing. To address such a situation, the signal processing unit 80 performs processing for deriving an update value ($Ne_1$) for updating the intensity of the internal light $L_1$ ($IL_1$) in the first color. The update value ($Ne_1$) is employed as the intensity of the internal light $L_1$ in the first color optimized through the exception processing.

Specifically, the signal processing unit 80 specifies a maximum value MAX(x) and a minimum value Min(x) of the gradation values {R(x), G(xa), B(xa)} obtained through the expression (32). The signal processing unit 80 calculates the update value $Ne_1$ through the following expression (33) using the specified MAX(x) and Min(x). In the expression (33) and the other expressions, KA represents the maximum value of the gradation value and is 255 in a case of 8 bits, for example.

$$Ne_1=\{(\mathrm{MAX}(x)-\mathrm{Min}(x))-(KA\times OL_1)\}/((KA\times OL_1)+\mathrm{Min}(x)) \quad (33)$$

The update value ($Ne_1$) for the first color has been described above. The signal processing unit 80 also derives an update value ($Ne_2$) for the second color and an update value ($Ne_3$) for the third color using the same mechanism as that of the update value ($Ne_1$) for the first color. These update values ($Ne_2$, $Ne_3$) are employed as the intensity of the internal light $L_1$ in the second color and the intensity of the internal light $L_1$ in the third color, respectively, which are optimized through the exception processing.

Specifically, the signal processing unit 80 defines the gradation values of the unit pixel 45A determining the intensity of the internal light $L_1$ ($IL_2$) in the second color as (R, G, B)={R(d), G(d), B(d)}. As represented by the following expression (34), the signal processing unit 80 calculates the gradation values {R(da), G(d), B(da)} in consideration of the intensities of the internal light $L_1$ ($IL_1$, $IL_3$) and the intensities of the external light $L_2$ ($OL_1$, $OL_3$) in the other colors. The signal processing unit 80 specifies a maximum value MAX(d) and a minimum value Min(d) of the gradation values {R(da), G(d), B(da)} obtained through the expression (34). The signal processing unit 80 calculates the update value $Ne_2$ through the following expression (35) using the specified MAX(d) and Min(d).

$$\{R(da),G(d),B(da)\}=\{R(d),G(d),B(d)\}/\{IL_1+OL_1,1,IL_3+OL_3\} \quad (34)$$

$$Ne_2=\{(\mathrm{MAX}(d)-\mathrm{Min}(d))-(KA\times OL_2)\}/((KA\times OL_2)+\mathrm{Min}(d)) \quad (35)$$

The signal processing unit 80 defines the gradation values of the unit pixel 45A determining the intensity of the internal light $L_1$ ($IL_3$) in the third color as (R, G, B)={R(n), G(n), B(n)}. As represented by the following expression (36), the signal processing unit 80 calculates the gradation values {R(na), G(na), B(n)} in consideration of the intensities of the internal light $L_1$ ($IL_1$, $IL_2$) and the intensities of the external light $L_2$ ($OL_1$, $OL_2$) in the other colors. The signal processing unit 80 specifies a maximum value MAX(n) and a minimum value Min(n) of the gradation values {R(na), G(na), B(n)} obtained through the expression (36). The signal processing unit 80 calculates the update value $Ne_3$ through the following expression (37) using the specified MAX(n) and Min(n).

$$\{R(na),G(na),B(n)\}=\{R(n),G(n),B(n)\}/\{IL_1+OL_1,IL_2+OL_2,1\} \quad (36)$$

$$Ne_2=\{(\mathrm{MAX}(n)-\mathrm{Min}(n))-(KA\times OL_3)\}/((KA\times OL_3)+\mathrm{Min}(n)) \quad (37)$$

The following describes a specific example of the processing using the expressions (32) to (37) described above based on the example illustrated in FIGS. 25 to 28. FIGS. 25 to 28 illustrate the example in the case of ($IL_1$, $IL_2$, $IL_3$)=(1, 0.5, 0), ($OL_1$, $OL_2$, $OL_3$)=(1, 1, 1), and KA=255.

In the example illustrated in FIGS. 25 to 28, the unit pixel 45A determining the intensity of the internal light $L_1$ ($IL_1$) in the first color is the first unit pixel 45A. Accordingly, {R(x), G(x), B(x)}=(510, 0, 255) is satisfied. Based on the expression (32) described above, the signal processing unit 80 calculates the gradation values {R(x), G(xa), B(xa)} in consideration of the intensities of the internal light $L_1$ ($IL_2$, $IL_3$)=(0.5, 0) and the intensities of the external light $L_2$ ($OL_2$, $OL_3$)=(1, 1) in the other colors as represented by the following expression (38).

$$\begin{aligned}\{R(x), G(xa), B(xa)\} &= (510, 0, 255)/\{1, 0.5+1, 0+1\} \quad (38)\\ &= (510, 0, 255)/\{1, 1.5, 1\}\\ &= (510, 0, 255)\end{aligned}$$

The signal processing unit 80 defines the maximum value (510) as MAX(x) and defines the minimum value (0) as Min(x) among the gradation values {R(x), G(xa), B(xa)}=(510, 0, 255) obtained through the expression (38). The signal processing unit 80 calculates the update value $Ne_1$ as represented by the following expression (39) based on the expression (33) described above using the specified MAX(x) and Min(x).

$$\begin{aligned}Ne_1 &= \{(510-0)-(255\times 1)\}/((255\times 1)+0) \quad (39)\\ &= 255/255\\ &= 1\end{aligned}$$

In the example illustrated in FIGS. 25 to 28, the unit pixel 45A determining the intensity of the internal light $L_1$ ($IL_2$) in the second color is the second unit pixel 45A. Accordingly, {R(x), G(x), B(x)}=(128, 510, 128) is satisfied. Based on the expression (34) described above, the signal processing unit 80 calculates the gradation values {R(da), G(d), B(da)} in consideration of the intensities of the internal light $L_1$ ($IL_1$, $IL_3$)=(1, 0) and the intensities of the external light $L_2$ ($OL_1$, $OL_3$)=(1, 1) in the other colors as represented by the following expression (40).

$$\begin{aligned}\{R(da), G(d), B(da)\} &= (128, 510, 128)/\{1+1, 1, 0+1\} \quad (40)\\ &= (128, 510, 128)/\{2, 1, 1\}\\ &= (64, 510, 128)\end{aligned}$$

The signal processing unit 80 defines the maximum value (510) as MAX(d) and defines the minimum value (64) as Min(d) among the gradation values {R(da), G(d), B(da)}=(64, 510, 128) obtained through the expression (40). The signal processing unit 80 calculates the update value $Ne_2$ as represented by the following expression (41) based on the expression (35) described above using the specified MAX(d) and Min(d).

$$\begin{aligned}Ne_2 &= \{(510-64)-(255\times 1)\}/((255\times 1)+64) \quad (41)\\ &= 191/319\\ &= 0.59\ \ldots\\ &\approx 0.6\end{aligned}$$

In the example illustrated in FIGS. 25 to 28, the unit pixel 45A determining the intensity of the internal light $L_1$ ($IL_3$) in the third color is the first unit pixel 45A. Accordingly, {R(n), G(n), B(n)}=(510, 0, 255) is satisfied. Based on the expression (36) described above, the signal processing unit 80 calculates the gradation values {R(na), G(na), B(n)} in consideration of the intensities of the internal light $L_1$ ($IL_1$, $IL_2$)=(1, 0.5) and the intensities of the external light $L_2$ ($OL_1$, $OL_2$)=(1, 1) in the other colors as represented by the following expression (42).

$$\{R(na), G(na), B(n)\} = (510, 0, 255)/\{1+1, 0.5+1, 1\} = (510, 0, 255)/\{2, 1.5, 1\} = (255, 0, 255) \quad (42)$$

The signal processing unit 80 defines the maximum value (255) as MAX(n) and defines the minimum value (0) as Min(n) among the gradation values {R(na), G(na), B(n)}=(255, 0, 255) obtained through the expression (38). The signal processing unit 80 calculates the update value $Ne_3$ as represented by the following expression (43) based on the expression (37) described above using the specified MAX(n) and Min(n).

$$Ne_3 = \{(255-0)-(255\times 1)\}/((255\times 1)+0) = 0/255 = 0 \quad (43)$$

Figures 30, 31:
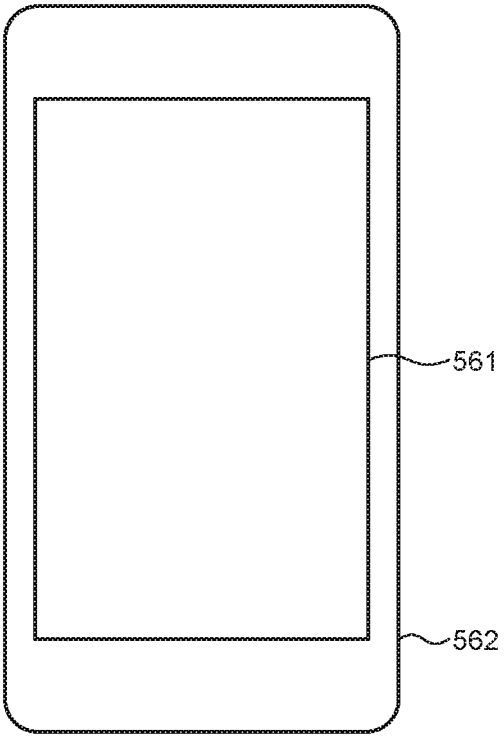
FIG. 30 is a diagram illustrating an example of the output gradation value in a case of receiving emitted light having light intensity corrected through the exception processing.
FIG. 31 is a diagram illustrating an example of the electronic apparatus to which the display device according to the embodiment and the like is applied.

FIG. 30 is a diagram illustrating an example of the output gradation value in a case of receiving emitted light having light intensity corrected through the exception processing. FIG. 30 illustrates an example of a case of applying the exception processing using the expressions (26), (27), and (28) when the output gradation values before the exception processing are calculated as in FIG. 28. The signal processing unit 80 employs a maximum value, an intermediate value, and a minimum value of the corrected intensity as the light intensity of the respective light sources included in the light source unit 50. In the case of ($IL_1$, $IL_2$, $IL_3$)=(1, 0.5, 0), the corrected values ($Ne_1$, $Ne_2$, $Ne_3$)=(1, 0.6, 0) calculated through the expressions (38) to (43) derived based on the expressions (32) to (37) are employed as ($IL_1$, $IL_2$, $IL_3$), and ($IL_1$, $IL_2$, $IL_3$)=(1, 0.6, 0) is obtained. The output gradation value (276) of the sub-pixel 48G of the second color included in the second unit pixel 45A cannot be exhibited with the intensity $IL_2$ of 0.5 before the exception processing, so that overflow occurs. By contrast, when the exception processing is performed, the intensity $IL_2$ is corrected to be 0.6, and thereby the output gradation value is reduced to a value (255) not exceeding the maximum value of the gradation value as illustrated in FIG. 30. In this way, according to the modification, overflow can be suppressed by applying the exception processing.

A specific configuration of the modification is the same as the specific configuration of the above embodiment except the characteristics specially mentioned. The arithmetic operation may be omitted for the color the intensity of the internal light $L_1$ of which is 0 before the correction. Specifically, the arithmetic operation such as the expressions (42) and (43) can be actually omitted. When the update value is calculated for the color the intensity of the internal light $L_1$ of which is 0 before the correction, the update value is a negative value in some cases. This means that the correction (update value) is not required because the external light L2 cannot be negatively corrected. Thus, the correction value is 0 even when the arithmetic operation is performed.

As described above, according to the modification, each of the sub-pixels 48 is a sub-pixel that outputs one of red (R), green (G), blue (B), and white (W), and the display panel 30 performs color reproduction by combining the outputs of the sub-pixel 48R of red (R), the sub-pixel 48G of green (G), the sub-pixel 48B of blue (B), and the sub-pixel 48W of white (W). By setting the gradation value corresponding to the component that can be converted into white among the color components of red (R), green (G), and blue (B) indicated by the RGB signal to be the gradation value of the sub-pixel 48W of white (W), the color component that can be converted into white can be converted into white to be output. Accordingly, the luminance can be easily increased by the sub-pixel 48W of white (W), and the supplement with the internal light $L_1$ can be reduced by the luminance increased by the sub-pixel 48W of white (W). Thus, according to the modification, power consumption can be further reduced, so that the supplement with the internal light $L_1$ can be minimized and intended luminance can be secured at the same time.

Application Example

Next, with reference to FIG. 31, the following describes an application example of the display device described in the embodiment and the modification (hereinafter, the embodiment and the like). FIG. 31 is a diagram illustrating an example of the electronic apparatus to which the display device according to the embodiment and the like is applied. The display device according to the embodiment and the like can be applied to electronic apparatuses in various fields such as car navigation systems, television apparatuses, digital cameras, notebook-type personal computers, portable terminal devices such as a cellular telephone illustrated in FIG. 31, or video cameras. In other words, the display device according to the embodiment and the like can be applied to electronic apparatuses in various fields that display a video signal input from the outside or a video signal generated in the display device as an image or video.

The electronic apparatus illustrated in FIG. 31 is a portable information terminal that operates as a portable computer, a multifunctional mobile phone, a mobile computer capable of making a voice call, or a mobile computer capable of performing communications to which the display device according to the embodiment and the like is applied, and may be called a smartphone or a tablet terminal in some cases. The portable information terminal includes, for example, a display unit 561 provided to a surface of a housing 562 as the display device according to the embodiment and the like. The display unit 561 has a function of the display device according to the embodiment and the like and a touch detection (what is called a touch panel) function that can detect an external proximity object.

The embodiment and the like according to the present invention have been described above. However, the embodiment and the like are not limited thereto. The components described above include a component that is easily conceivable by those skilled in the art, substantially the same component, and what is called an equivalent. The components described above can also be combined with each other as appropriate. In addition, the components can be variously omitted, replaced, or modified without departing from the gist of the embodiment and the like described above.

A plurality of units of processing are set in the embodiment and the like described above. Alternatively, all effective display regions included in the display unit 10 may be set as one unit of processing. That is, the predetermined image display region included in the display unit 10 may be all of the effective display regions included in the display unit 10. In this case, a function of individually controlling each light emitting region may be eliminated from the illumination unit 20. The predetermined image display region is not limited to the example described above, and may be freely set in the effective display region included in the display unit 10.

The combination of the first color, the second color, and the third color in the above embodiment is merely an example. The embodiment is not limited thereto, and can be modified as appropriate. For example, the combination of the first color, the second color, and the third color may be a combination of cyan (C), magenta (M), and yellow (Y).

The fourth color in the above embodiment is merely an example. The embodiment is not limited thereto, and can be modified as appropriate. For example, the fourth color may be a complementary color of the color of the other sub-pixel 48 such as yellow (Y), or may be any other color.

What is claimed is:

1. A display device that is a reflective display device comprising:

a display unit including a plurality of pixels performing color reproduction by combining outputs of sub-pixels of three or more colors including at least a first color, a second color, and a third color;

an illumination unit including a first light source that emits light in the first color to the display unit, a second light source that emits light in the second color to the display unit, and a third light source that emits light in the third color to the display unit;

a sensor that measures intensity of light in each color of the first color, the second color, and the third color included in external light that is light other than the light from the illumination unit out of the light emitted to the display unit; and a signal processing unit that controls the intensity of the light to be emitted from each of the first light source, the second light source, and the third light source and controls gradation values of the respective sub-pixels based on the intensity of the external light measured by the measuring unit, wherein the signal processing unit individually performs, on the sub-pixel of the first color, the sub-pixel of the second color, and the sub-pixel of the third color, processing of calculating a necessary luminance value for obtaining luminance that is N times a luminance value indicated by an input signal in a sub-pixel that performs output with a highest gradation value among the sub-pixels included in a predetermined image display region in the display unit, N being larger than 0, the signal processing unit determines the intensity of the light to be emitted from each of the first light source, the second light source, and the third light source based on a comparison result between the necessary luminance value and the intensity of the light in each of the first color, the second color, and the third color included in the external light, and the signal processing unit calculates an output gradation value of each of the sub-pixel of the first color, the sub-pixel of the second color, and the sub-pixel of the third color based on the following expressions (1), (2), and (3):

$$O_1=I_1\times N/(OL_1+IL_1) \quad (1),$$

$$O_2=I_2\times N/(OL_2+IL_2) \quad (2), \text{ and}$$

$$O_3=I_3\times N/(OL_3+IL_3) \quad (3),$$

where $OL_1$ is the intensity of the light in the first color included in the external light, $OL_2$ is the intensity of the light in the second color included in the external light, $OL_3$ is the intensity of the light in the third color included in the external light, $IL_1$ is the intensity of the light to be emitted from the first light source, $IL_2$ is the intensity of the light to be emitted from the second light source, $IL_3$ is the intensity of the light to be emitted from the third light source, $I_1$ is the gradation value of the first color indicated by the input signal, $I_2$ is the gradation value of the second color indicated by the input signal, $I_3$ is the gradation value of the third color indicated by the input signal, $O_1$ is the output gradation value for the sub-pixel of the first color, $O_2$ is the output gradation value for the sub-pixel of the second color, and $O_3$ is the output gradation value for the sub-pixel of the third color.

2. The display device according to claim 1, wherein the display unit includes a plurality of partial regions each including the pixels, the illumination unit includes a plurality of light emitting regions that individually emit light to each of the partial regions, the first light source, the second light source, and the third light source are provided so that the intensity of the emitted light is able to be individually controlled in each of the light emitting regions, and the signal processing unit calculates a necessary luminance value of one light emitting region corresponding to the one partial region serving as the predetermined image display region, determines the intensity of the light in each of the first light source, the second light source, and the third light source to be emitted from the one light emitted region, and calculates output gradation values of the sub-pixel of the first color, the sub-pixel of the second color, and the sub-pixel of the third color included in each of the pixels included in the one partial region.

3. The display device according to claim 1, wherein the signal processing unit calculates the output gradation value of each of the sub-pixel of the first color, the sub-pixel of the second color, and the sub-pixel of the third color based on the expressions (1), (2), and (3) after correcting the gradation value of the first color, the gradation value of the second color, and the gradation value of the third color indicated by the input signal using a ratio of the first color, the second color, and the third color constituting white to be reproduced by combining the first color, the second color, and the third color.

4. The display device according to claim 3, wherein the signal processing unit defines a ratio of the intensities of the light in the first color, the second color, and the third color measured by the measuring unit as the ratio of the first color, the second color, and the third color constituting white.

5. The display device according to claim 3, wherein the signal processing unit equalizes all values of the ratio of the first color, the second color, and the third color constituting white.

6. The display device according to claim 1, wherein the pixels each include a sub-pixel of a fourth color, and the signal processing unit defines a color component as a gradation value of the sub-pixel of the fourth color, the color component being able to be output from the sub-pixel of the fourth color and being included in color components included in a color to be reproduced by combining gradation values of the first color, the second color, and the third color indicated by the input signal.

7. The display device according to claim 6, wherein the fourth color is white.

8. The display device according to claim 1, wherein the first color, the second color, and the third color are red, green, and blue, respectively.

* * * * *